US006321951B1

(12) United States Patent
Frutin

(10) Patent No.: US 6,321,951 B1
(45) Date of Patent: Nov. 27, 2001

(54) DISPENSING APPARATUS

(75) Inventor: Bernard Dereck Frutin, Renfrewshire (GB)

(73) Assignee: Rocep Lusol Holdings Limited, Deanpark (GB)

( * ) Notice: Subject to any disclaimer, the term of this patent is extended or adjusted under 35 U.S.C. 154(b) by 0 days.

(21) Appl. No.: 09/529,290

(22) PCT Filed: Oct. 7, 1998

(86) PCT No.: PCT/GB98/03003

§ 371 Date: Apr. 7, 2000

§ 102(e) Date: Apr. 7, 2000

(87) PCT Pub. No.: WO99/18010

PCT Pub. Date: Apr. 15, 1999

(30) Foreign Application Priority Data

| | | |
|---|---|---|
| Oct. 7, 1997 | (GB) | 9721120 |
| Jan. 16, 1998 | (GB) | 9800825 |
| Jun. 27, 1998 | (GB) | 9813865 |

(51) Int. Cl.[7] ..... F16J 1/00

(52) U.S. Cl. ..... 222/389; 92/159; 92/160; 92/255

(58) Field of Search ..... 222/386.5, 386, 222/389, 406; 92/160, 159, 255

(56) References Cited

U.S. PATENT DOCUMENTS

| | | | | |
|---|---|---|---|---|
| 2,430,718 | * | 11/1947 | Jacobson | 222/386 |
| 2,961,131 | | 11/1960 | Bradbury | 222/394 |
| 4,106,674 | | 8/1978 | Schultz | 222/386.5 |
| 4,109,833 | * | 8/1978 | Gross | 222/386.5 |
| 4,685,597 | * | 8/1987 | Hirao et al. | 222/389 |
| 4,979,652 | | 12/1990 | Saulle | 222/402.16 |
| 5,040,705 | | 8/1991 | Snell | 222/402.15 |

FOREIGN PATENT DOCUMENTS

| | | |
|---|---|---|
| 91 11 698.8 | 2/1992 | (DE) . |
| 2 554 792 A1 | 5/1985 | (FR) . |
| 2 568 975 A1 | 2/1986 | (FR) . |
| 2 677 620 A1 | 12/1992 | (FR) . |
| 87/02335 | 4/1987 | (WO) . |
| 95/09785 | 4/1995 | (WO) . |

* cited by examiner

*Primary Examiner*—Kevin Shaver
*Assistant Examiner*—Patrick Buechner
(74) *Attorney, Agent, or Firm*—Ratner & Prestia

(57) ABSTRACT

A dispensing apparatus for dispensing a product from a container under pressure of a propellant by means of a composite piston (138). The apparatus has a valve (104) operated by means of an actuator (108) and a lever (166). The actuator co-operates with the valve and lever by means of a screw thread arrangement (110), such that turning actuator relative to the lever varies the flow rate of product out of the apparatus. The valve is a hollow cylindrical tube (104) which is open at one end and closed at the second end, either permanently or by means of a flap valve (112) which allows insertion of the product. A number of ports (116) are arranged around the circumference of the tube (104) adjacent to the second end to allow product to flow through the valve when the lever is operated. The composite piston (138) comprises a first piston (140*a*) coupled to a second piston (140*b*) by mutually engageable central stems (142*a, b*) and enclosing between the pistons a viscous substance which contacts the inside wall of the container to provide an effective seal. The piston arrangement of the apparatus stays together without the need for "necking in" the can and the apparatus can be filled with product by the manufacturer.

14 Claims, 18 Drawing Sheets

DISPENSING APPARATUS

This application is the U.S. national phase application of PCT International Application No. PCT/GB98/03003 filed Oct. 7, 1998.

This invention relates to dispensing apparatus. Particularly, but not exclusively it relates to dispensing apparatus for dispensing viscous materials from a container under pressure of a propellant.

BACKGROUND OF THE INVENTION

Known dispensing apparatus commonly include a valve mechanism fitted to a container which is refilled with a product, for example mastic or sealant, which is to be dispensed. Examples are disclosed in Patent document EP-B-0243393 (Rocep Lusol Holdings Limited). However, known arrangements have several disadvantages.

For example, the cost of components used in the manufacture of such known apparatus is high. This is particularly true in relation to the cans used as containers in such apparatus. Further, automatic assembly of such apparatus is complicated and costly.

Yet another disadvantage is that the product must be filled into the dispensing apparatus during manufacture of the apparatus. This involves the product manufacturer supplying the product in bulk to the apparatus manufacturer who then returns the filled apparatus to the product manufacturer for sale. This is costly and inconvenient. As a result of the foregoing, the overall costs associated with presently available dispensing apparatus are high.

Known dispensing apparatus, such as that disclosed in EP-B-0089971 (Rocep Lusol Holdings Limited), include piston arrangements which are designed to prevent propellant gas in the apparatus from coming into contact with the product to be dispensed. Commonly, these piston arrangements consist of a pair of pistons with sealant therebetween. However, known arrangements can be costly to manufacture and have the significant disadvantage that after filling of the apparatus, and during storage, the sealant expands causing the pistons to separate from one another. This problem has to be addressed by "necking in" the can (ie locally reducing the diameter of the can) below the piston assembly to prevent separation. It would be desirable to have a piston arrangement which would stay together without the need for "necking in" the can.

It would also be desirable to have dispensing apparatus such that a manufacturer can fill the apparatus with product himself, after the apparatus has been assembled and/or pressurised, and to have dispensing apparatus which is refillable.

SUMMARY OF THE INVENTION

According to a first aspect of the present invention there is provided dispensing apparatus for dispensing a product from a container under pressure of a propellant, said apparatus comprising a product chamber within the container and a valve adjacent to the product chamber characterised in that the valve allows product flow into and out of the product chamber.

Preferably, the product chamber is pressurised. The product chamber preferably contains a piston, situated between the propellant and the valve.

Preferably, the piston is an interlocking double piston. The interlocking sections preferably have a sealant between them. The sealant forms a substantially impenetrable barrier between the propellant and the product.

Preferably, the valve is operated by means of an actuator and a lever. The lever may be manufactured of plastics material; it may be manufactured as a single piece of plastic, for example by injection moulding.

Preferably, the actuator and the lever co-operate by means of a screw thread arrangement. Turning of the actuator relative to the lever may vary the flow rate of product out of the apparatus. Turning may be possible from a "lock-off" position, in which the actuator is clicked home, to a fully on position. Markings may be provided to show the flow rate corresponding to predetermined positions on the lever.

Means may be provided to demonstrate to a user that the actuator is in the closed position, ie the position in which no product can flow. It is further preferred that the actuator is provided with means to limit the travel of the actuator once the fully open position is reached. Said means may also prevent the actuator from being opened too far or being completely removed from the apparatus. Said means may be a groove or substantially axial slot in the external wall of the actuator.

Preferably, the container is made substantially from tin plate or aluminium. Most preferably the container is a wall ironed tin plate can. For example, it may be an extruded tin plate can as used in the beverage industry, without a side seam.

According to a second aspect of the present invention there is provided a composite piston for use in dispensing apparatus, said composite piston comprising a first piston, a second piston and a coupling means, the coupling means movably coupling the first and second pistons to each other and permitting limited relative movement between the first and second pistons in a direction substantially parallel to the direction of movement of the composite piston.

Preferably the first and second pistons interlock in use defining a piston sealant chamber.

Preferably the piston sealant chamber is open circumferentially.

Preferably, the coupling means comprises a projection on one of the first and second pistons and a recess in the other of the first and second pistons, and the projection engages in the recess to couple the pistons to each other.

Typically, the projection is of a smaller dimension than the recess to permit movement of the projection within the recess to facilitate the limited relative movement of the first and second pistons. Preferably, the projection and the recess include mutually engageable ratchet formations which permit movement of the pistons relative to each other in one direction only. Preferably, the one direction is movement of the pistons towards each other.

Typically, the recess is a central aperture in one of the pistons and the projection is a central projection on the other piston arranged to engage the recess.

Preferably, the first piston and/or the second piston may be elastically distorted to permit a push fit engagement of the projection into the recess.

Typically, the pistons may be manufactured from a flexible material, such as plastic.

Preferably, the composite piston also includes a viscous substance which in use contacts the inside wall of a container adjacent the composite piston. The viscous substance may help to facilitate sealing of the composite piston against the inside walls of the container and/or reduce friction between the composite piston and the inside walls of the container.

Preferably the viscous substance is a sealant, such as a glycerine and starch mixture. Preferably the sealant is adapted to contact the interior surface of the container, thereby forming a seal. This seal may be an annular ring of sealant in contact with the container. This prevents propellant in the apparatus from coming into contact with product in the apparatus.

One or both of the primary and secondary portions may be provided with an aperture and/or a valve to allow gas to escape out of the sealant chamber in use. Said valve may be a check valve; it may be provided in a stem provided in the centre of the secondary portion.

Preferably the piston assembly is provided with means for accommodating expansion of the sealant, in use. This may help prevent piston separation. Said means may be thinned portions provided on the primary and/or secondary piston. Preferably, said means is a plurality of thinned pockets in the wall of the secondary piston. These pockets may balloon to accommodate sealant expansion in use.

According to a third aspect of the present invention there is provided a container for dispensing a product therefrom, the container comprising a piston according to the second aspect movably mounted within the container and an outlet through which the product is dispensed, the container walls and the composite piston defining a product chamber within the container, and movement of the composite piston within the container towards the outlet expelling product through the outlet.

Typically, the viscous material is located between the first and second pistons and may be forced into engagement with the inside wall of the container by a compression force which acts between the first and second pistons to cause the second piston to move towards the first piston.

Preferably, the composite piston also includes a wall engaging skirt which abuts against an inside wall of the container. Preferably, a wall-engaging skirt is provided on both the first and the second pistons.

Preferably, the container is a pressure pack dispenser which comprises a propellant system which pushes the piston towards the outlet. However, alternatively, the piston could be used in combination with a mechanical actuating device which pushes the composite piston towards the outlet of the container.

According to a fourth aspect of the present invention, there is provided a container for use in dispensing apparatus, said container comprising a hollow cylindrical portion and a boss portion, said cylindrical portion being open at one end for attachment of a sealing dome and having a curled in portion at the other end for engagement with a corresponding flange provided on the boss portion.

Preferably, the cylindrical portion is made substantially from tin plate or aluminium or other suitable material.

BRIEF DESCRIPTION OF THE DRAWINGS

Specific embodiments of the invention will now be described, by way of example only, with reference to the accompanying drawings in which.

DETAILED DESCRIPTION OF THE INVENTION

Figure 1:
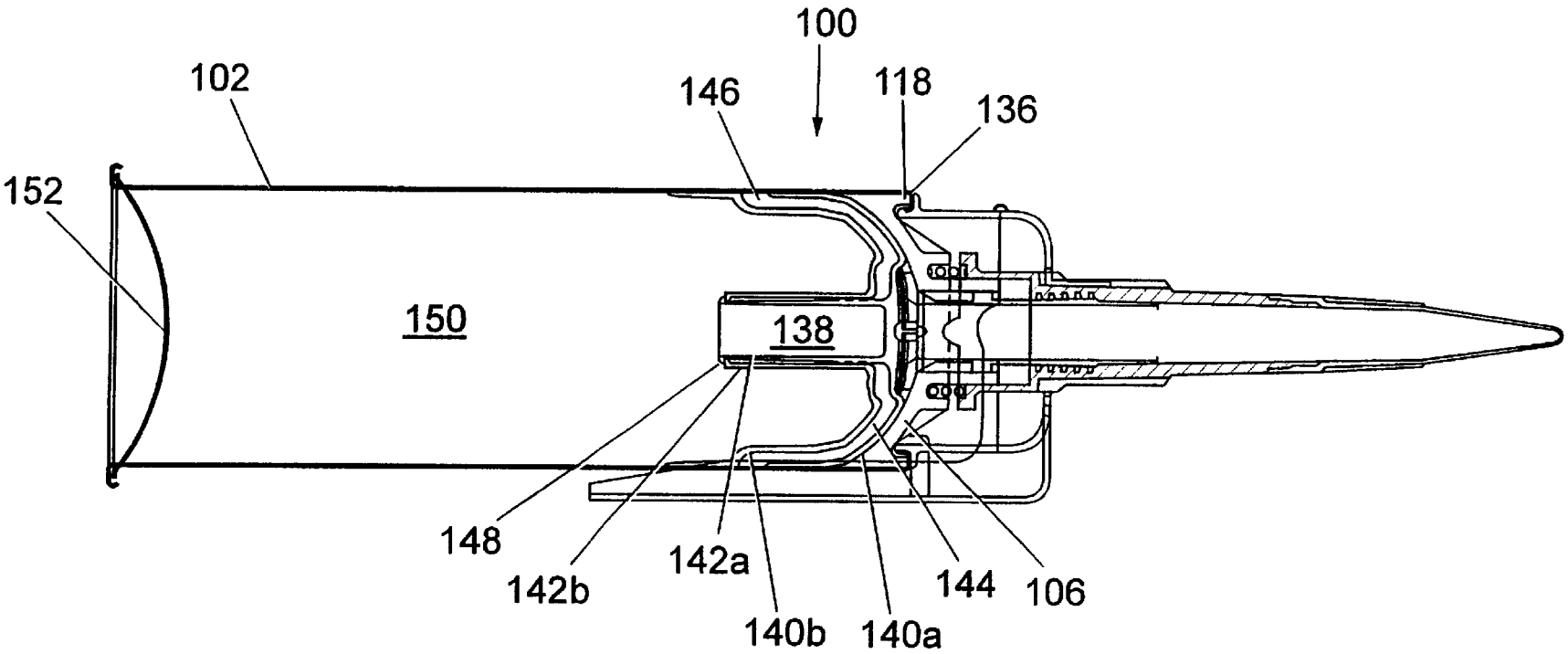
FIG. 1 is a side view in cross-section of dispensing apparatus in accordance with an embodiment of the present invention.

Referring firstly to FIG. 1 of the accompanying drawings, apparatus in accordance with an embodiment of the present invention will be described. The apparatus will be referred to hereinafter as a "pressure pack" or "pack". The pressure pack of FIG. 1 is generally denoted 100.

The pack 100 consists generally of a canister section and a valve section.

In this example, the canister section comprises a standard preformed cylindrical can 102 which is internally lacquered. It is envisaged that the can 102 could be a tin plate beverage can having a bore in the top. Alternatively the can 102 could be manufactured from aluminium.

Figure 2:
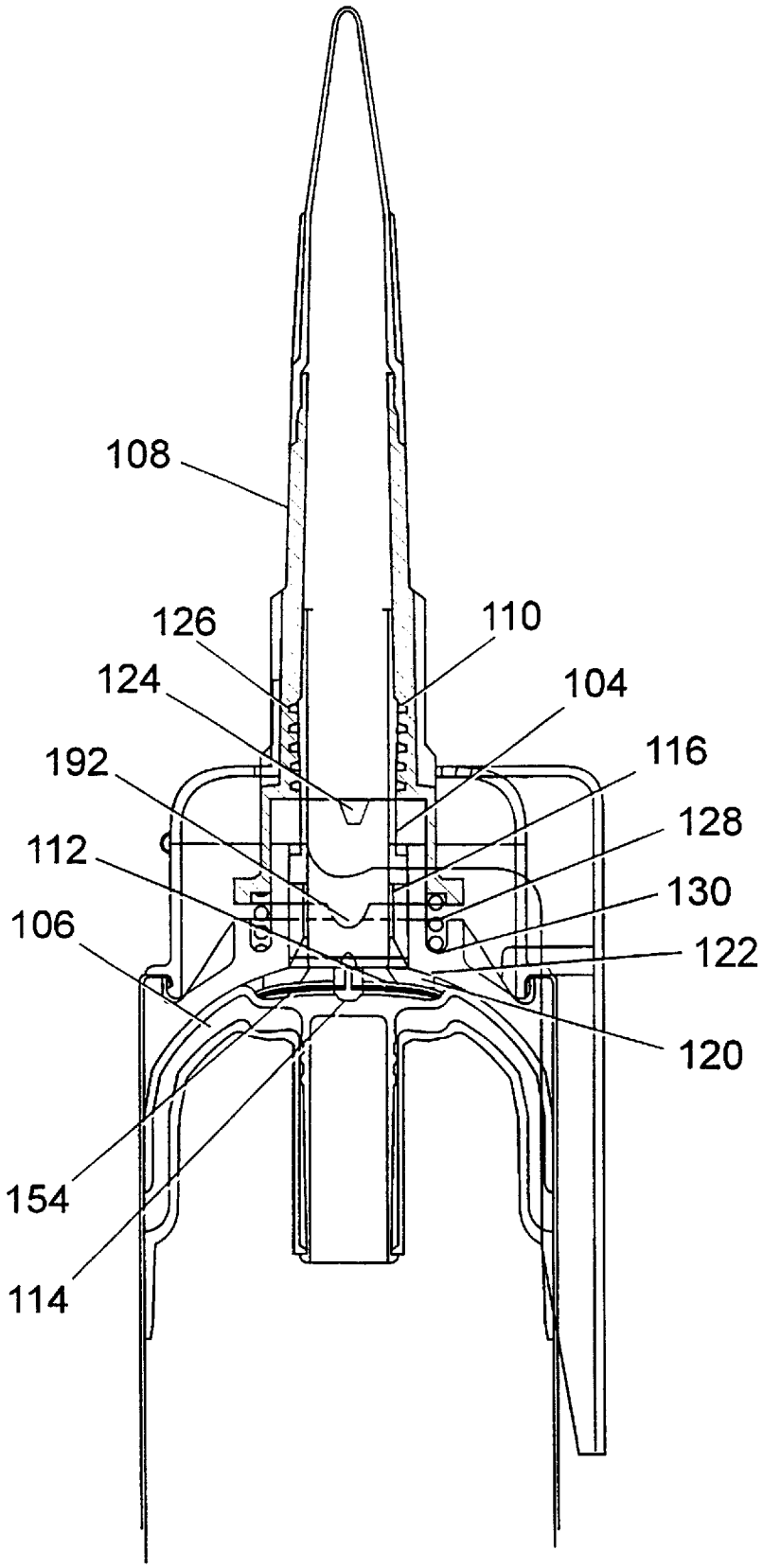
FIG. 2 is an enlarged view of the valve area of the apparatus of FIG. 1.
Figure 4:
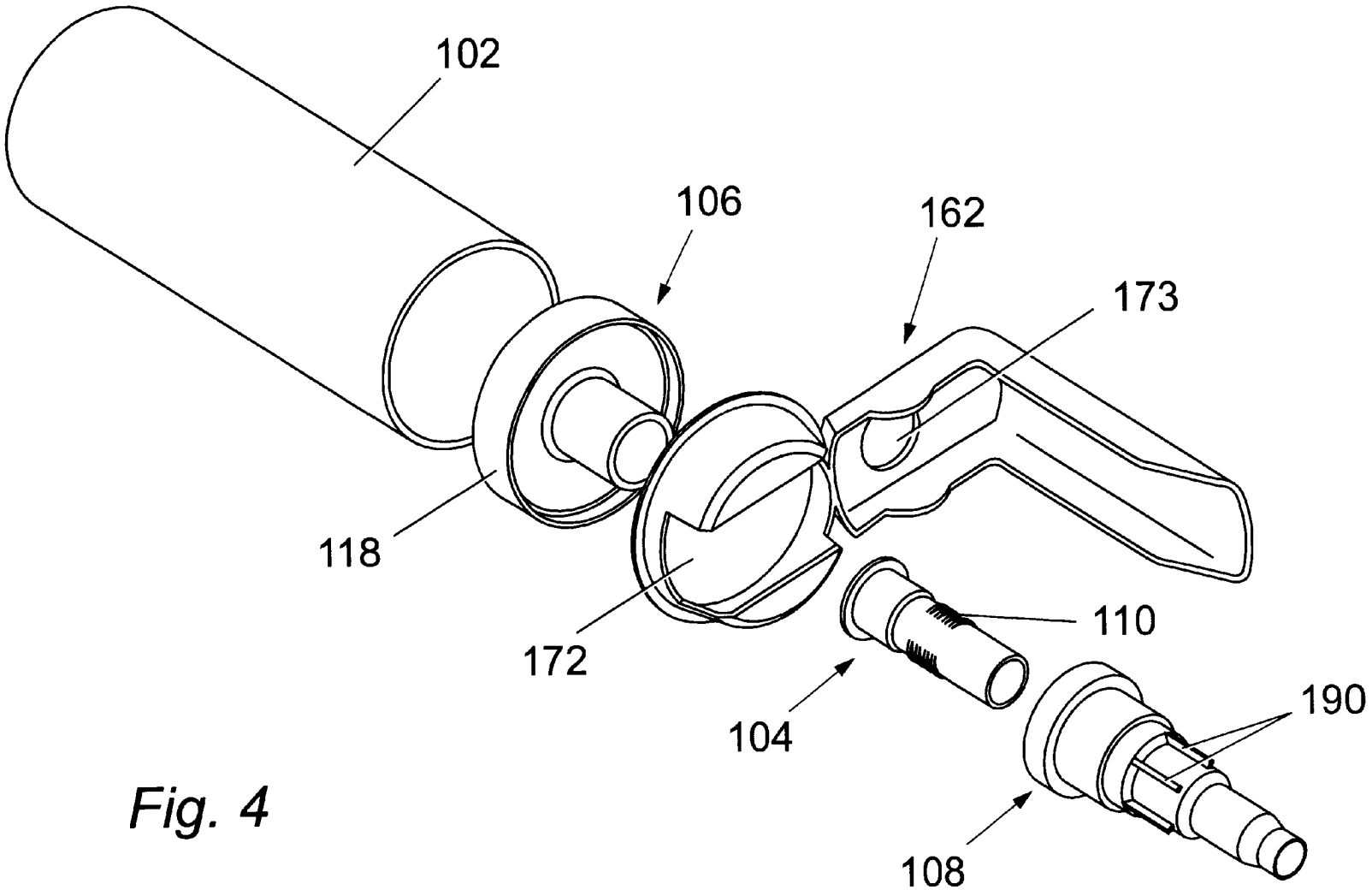
FIG. 4 is an exploded view in perspective of the apparatus of FIG. 1 without a piston, nozzle or overlap.

The pack 100 is automatically assembled as follows, with reference to FIGS. 1, 2 and 4 in particular of the accompanying drawings.

Firstly a sub-assembly is formed from a valve portion 104, a boss 106 and an actuator 108, as will now be described in more detail with reference to FIGS. 1, 2 and 4.

Figure 7:
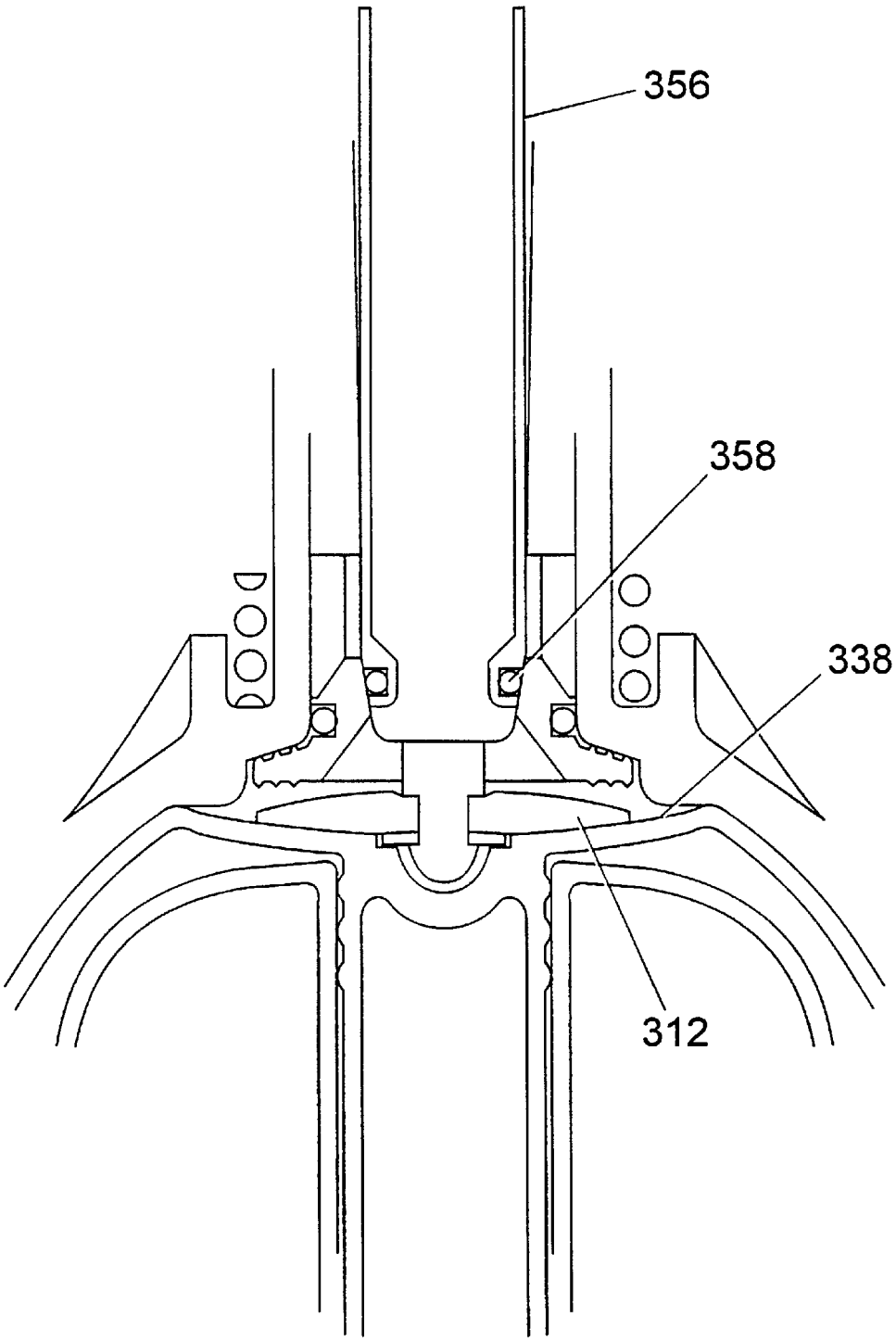
FIG. 7 is an enlarged -cross-sectional view of the piston crown area of apparatus in accordance with a preferred embodiment of the present invention at the start of a fill cycle.

The valve portion 104 is a substantially hollow cylindrical tube, provided with a screw thread 110 on its exterior surface. The valve portion 104 is open at one end (the top as viewed in FIG. 2) and has a flap valve 112 attached to its other end by means of a rivet 114. The valve portion 104 is also provided with, in this example, four ports 116 around its exterior surface adjacent the screw thread 110 (to the bottom of the screw thread 110 as viewed in FIG. 2). It should be noted at this stage that the flap valve 112 is made from a rubber disc which preferably naturally lies in the open position (ie not sealing the end of the valve). This allows air to be expelled out of the pack, through the valve, during pressurisation. The most preferred form of flap valve 312 is shown in FIG. 7. The flap valve 112 is shown in the closed position in FIGS. 1 and 2. It should further be noted that the total area of the ports 116 exceeds the cross-sectional area of the valve portion 104 itself.

The boss 106 is a substantially hollow cylinder with a large flange portion 118 at one end. The valve portion 104 fits snugly within the hollow of the boss 106. The valve portion 104 is fitted into the boss 106 open-end-first and is prevented from moving too far up the boss 106 by abutment of the shaped end profile 120 of the valve portion against a corresponding portion 122 of the boss 106. This can be seen in FIG. 2, but is also described later with reference to FIG. 7. Further, the valve portion 104 may be prevented from falling out of the boss 106 by means of a clip 124 on the exterior of the valve portion 104 which interacts with a slot (not shown) in the interior surface of the boss 106. It should be emphasised, however, that this is an entirely optional feature.

The actuator 108 is a moulded plastic component having a hollow cylindrical interior and a stepped exterior surface. A screw thread 126 is provided on the interior surface of the actuator 108.

Following insertion of the valve portion 104 into the boss 106 (and clicking into place) the actuator 108 is placed over the end of the valve portion 104 and screwed onto it by means of cooperation of screw threads 110 and 126. (An optional spring 128 may be dropped into a groove 130 provided in the boss 106 prior to fitting the actuator 108. The spring 128 is designed to close the valve if this does not happen automatically, as will be explained later.)

Screwing on the actuator 108 completes the sub-assembly.

Figure 3:
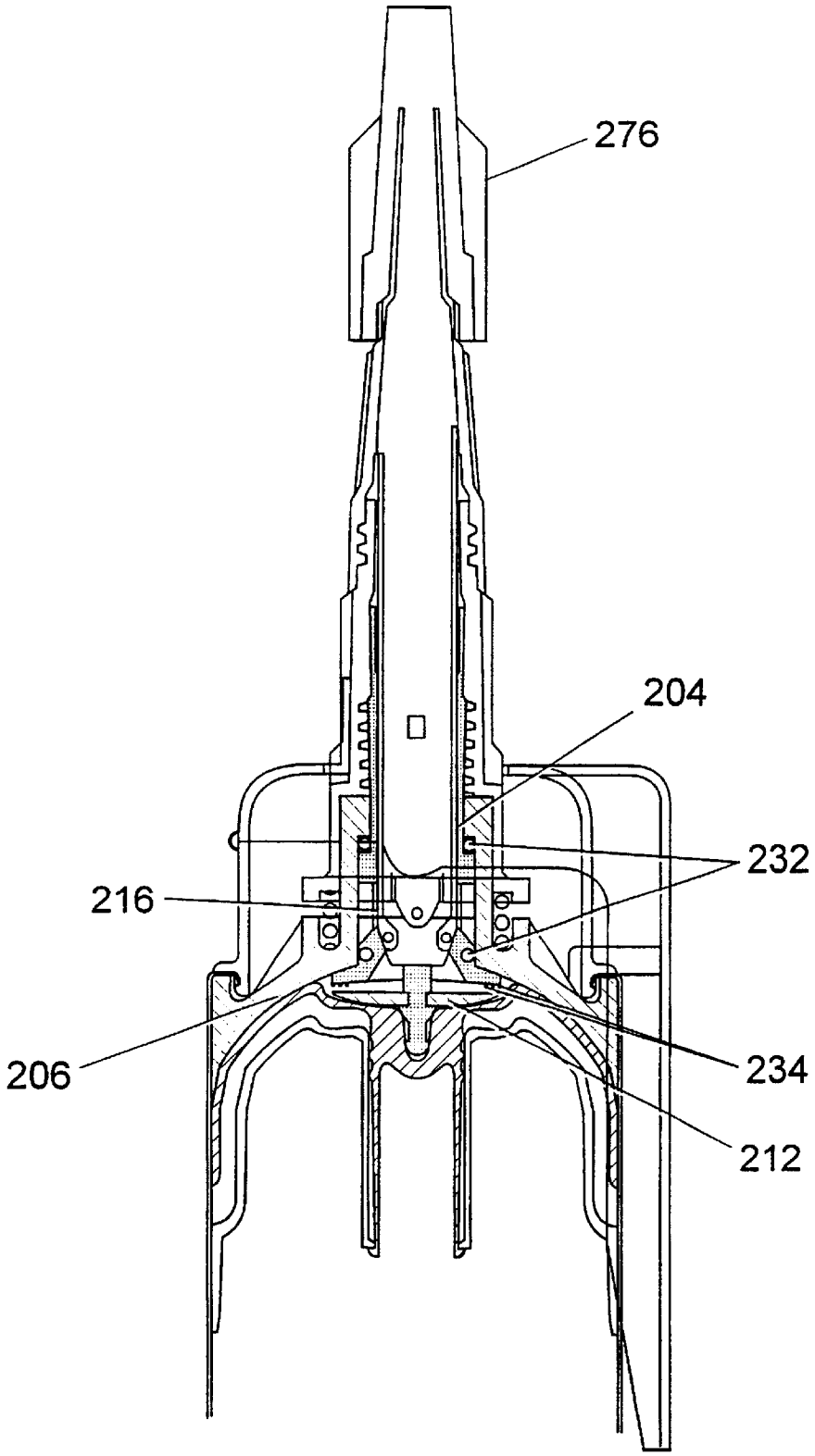
FIG. 3 is an enlarged view in cross-section of the valve area of apparatus in accordance with another embodiment of the present invention.

Referring now to FIG. 3, for ease of understanding, the reference numerals prefixed "1" are the same but prefixed "2". In this embodiment, optional O-rings 232 may be provided in annular grooves around the valve portion 204 either side of the ports 216. These O-rings 232 help to form air-tight and product-tight seals, respectively.

Rings 234 may also be provided on the surface of the flap valve 212 end of the valve portion 204 where it meets the boss 206. The rings 234 form air-tight (plastic-to-plastic) seals between the boss 206 and the valve portion 204, and the flap valve 212 and the valve portion 204 when these components are in contact.

Referring again to FIGS. 1 and 2, the sub-assembly is then inserted up the inside of the can 102 until the flange 118 provided on the boss 106 fits into a curled lip 136 at the top of the can 102. This limits further movement of the boss 106. The boss 106 should be a friction fit within the can 102, thereby sealing the end of the can 102. However, if necessary the neck of the can 102 may be crimped below the boss 106 to hold the sub-assembly in place.

Following insertion of the sub-assembly, a double piston assembly 138 is inserted into the can 102. The piston assembly 138 comprises two interlocking plastic cup sections 140*a,b*, each having a stem portion 142*a,b* in its centre. The cup sections 140*a,b* lock together and a cavity or chamber 144 is formed between them.

The outer surface of the double piston assembly 138 is in sliding contact with the internal surface of the can 102. The chamber 144 is filled with a measured quantity of sealant to form a pressure seal. The sealant not only fills the chamber 144, but also fills the annular space 146 in contact with the internal surface of the can 102.

The piston assembly 138 is formed by squirting sealant (in this case glycerine and starch mix at +45° C.) into the first cup 140*a* or "first piston", then allowing the sealant to cool and placing the second cup 140*b* or "second piston" onto the first 140*a*. This is done prior to insertion of the piston assembly 138 into the can 102. As the second piston 140b is fitted into the first 140*a*, the sealant is displaced within the cavity 144 formed between them. There is a minor "click" at this stage as the pistons 140*a,b* engage each other. Then the piston assembly 138 is rammed up the can 102 to the boss 106 and as this occurs the two pistons 140*a,b* are forced together. There is another "click" as the pistons 140*a,b* then lock together by means of a clip mechanism 148 on the stems 142*a,b*. At this second click the sealant is displaced into the annular ring 146 to form a propellant-tight seal. Other methods of interlocking the pistons and/or introducing the sealant are envisaged.

This piston arrangement gives advantages over known piston arrangements. For example, the hollow stem 142*b* of the second piston 140*b* permits air to exit the space between the first and second pistons 140*a* and 140*b*, up to the time when they lock together. In a modification (not shown) the first piston could be provided with a central valve, to permit passage of air from above the piston assembly.

The volume 150 of the can 102 behind the piston assembly 138 is now pressurised in the conventional way, for example to 70 psi for a 47 mm diameter can, and an aerosol dome 152 fitted thereby sealing the pack 100. It is envisaged that, at this stage, the pack 100 will be supplied to the customer (ie a product manufacturer) for filling, labelling and fitting of the nozzle and the lever mechanism described below. The product may be fixant, sealant, glue or the like. Alternatively, it could be a foodstuff such as cake icing, or a pharmaceutical, or a cosmetic product such as depilatory cream.

At this stage, it should be noted that a small air space 154 is left between the piston assembly 138 and the valve 104. This can be seen, for example, in FIG. 2. The airspace 154 is of a minimum size of 2 ml and is provided by shaping the crown of the piston 140*a* to fit the valve profile and the boss 106 leaving the required gap. Once the pack is pressurised, the increased pressure against the flap valve keeps it in the closed position.

Figure 6:
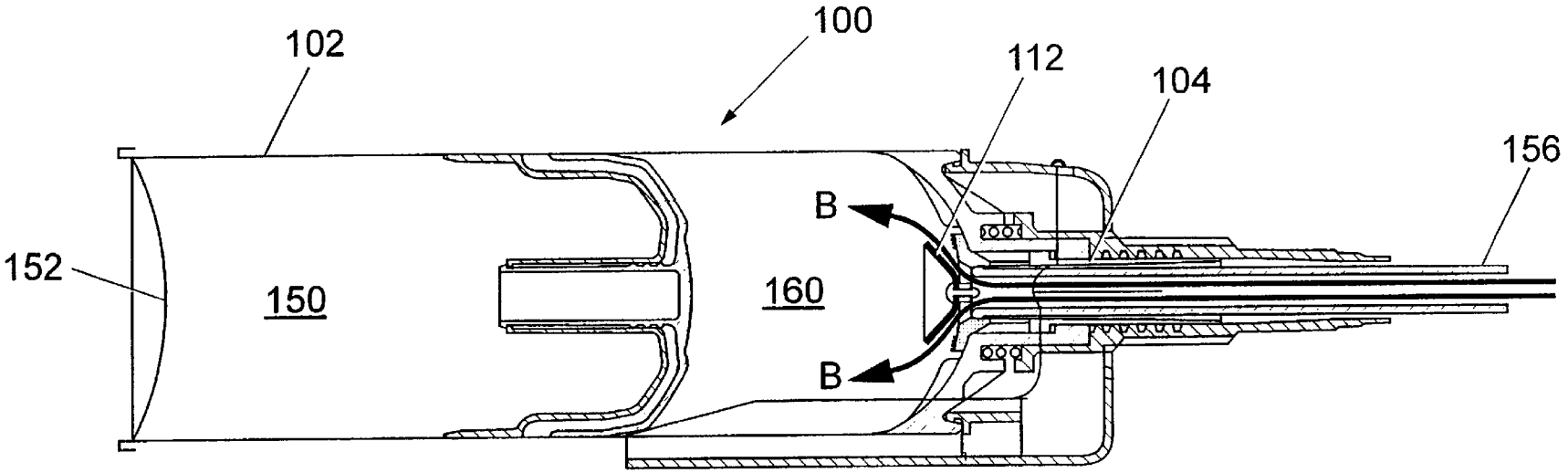
FIG. 6 is a side view in cross-section of the apparatus of FIG. 1 during filling.

FIG. 6 is a view of the pack 100 during filling. Filling may be done by a manufacturer of the product at their own premises. A bulk pack of product (not shown) is filled into the can 102 by means of a product fill tube 156 in the direction of arrows B in FIG. 6.

The tube 156 is inserted down through the interior of the valve portion 104 until the end of the tube 156 is adjacent the flap valve 112. (In a preferred embodiment, as seen in FIG. 7, a seal is formed around the tube 356 by means of an O-ring 358.)

As product is introduced (for example, in excess of 183 psi to fill a can at 70 psi) a small amount fills the gap 154 between the piston 138 and the valve/boss assembly. This product then begins to force the piston assembly 138 down into the can 102 against the pressure of the propellant in volume 150. The piston crown is specially profiled to enable product to flow down over the piston to enable this initial movement to occur. A preferred design of piston 338 is also shown in FIG. 7.

As the product continues to flow down the fill tube 156 the piston assembly 138 is forced down the can 102 toward the dome 152. Flap valve 112 is then able to return to its natural position, ie the open position, and further product flows into the volume 160 between the piston crown and the boss/valve. This filling continues until the required product fill is achieved or the piston 138 reaches the dome 152 (ie as seen in the view of FIG. 8*a*) whichever is sooner.

Figure 5:
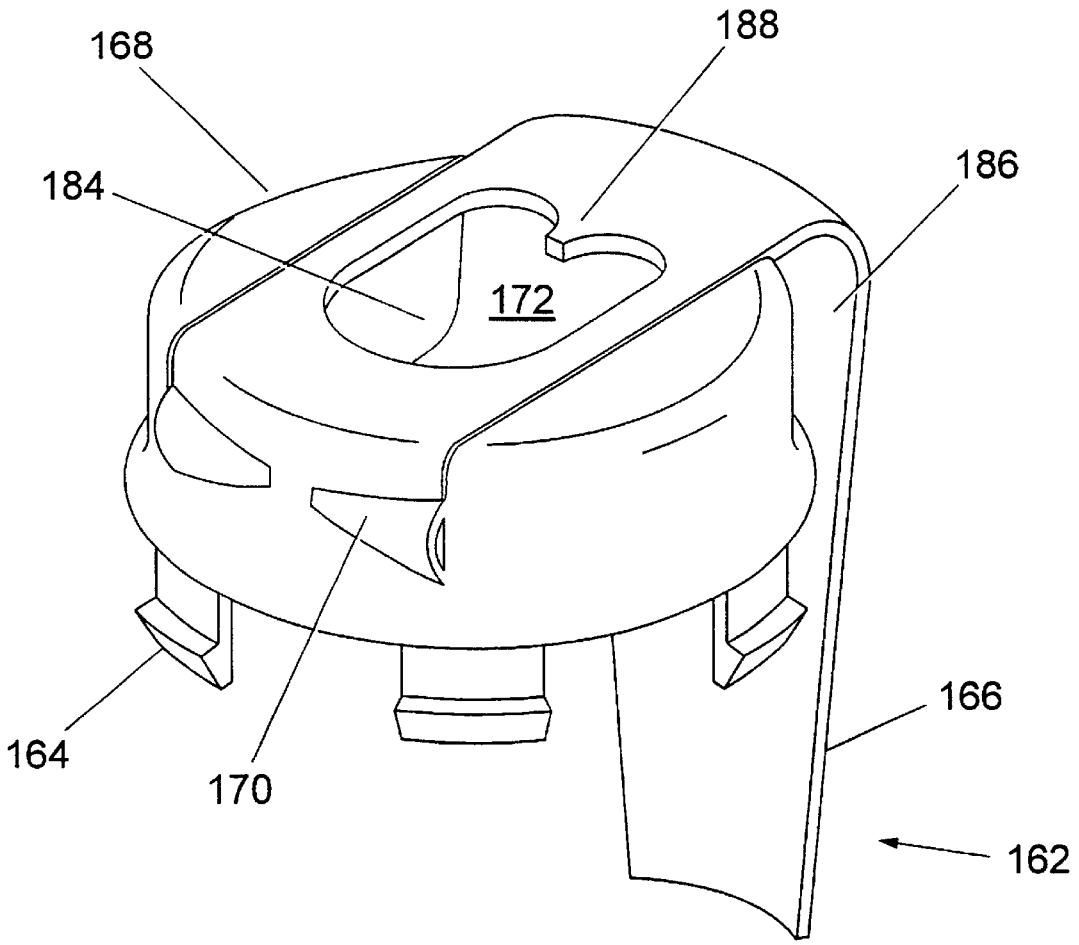
FIG. 5 is a sketch of a lever mechanism for use in the apparatus of FIG. 1.

The customer can then affix a label or other identifying feature to the filled can 102 and then a lever cap 162 is placed over the protruding parts of the boss 106, the valve 104 and the actuator 108. The lever cap 162 is shown in FIG. 5 and is provided with snappers 164 around its bottom edge. These snappers 164 are resiliently formed and once "snapped" into place co-operate with the lip 136 of the can 102 to hold the lever cap 162 securely in place.

The lever cap 162 is moulded as a single piece of plastic and has a handle 166 and a base 168. The handle 166 is joined to the base 168 by means of a butterfly hinge 170. The handle 166 and base 168 are each provided with overlapping apertures 172, 173 through which parts of the valve portion 104 and the actuator 108 protrude when the lever cap 162 is in place. The handle 166 is folded over on the hinge 170 so that these apertures 172 overlap. FIG. 4 shows various parts of the pack 100 exploded. In FIG. 4 the lever cap 162 is shown in the open (ie moulded) position.

Figure 8A:
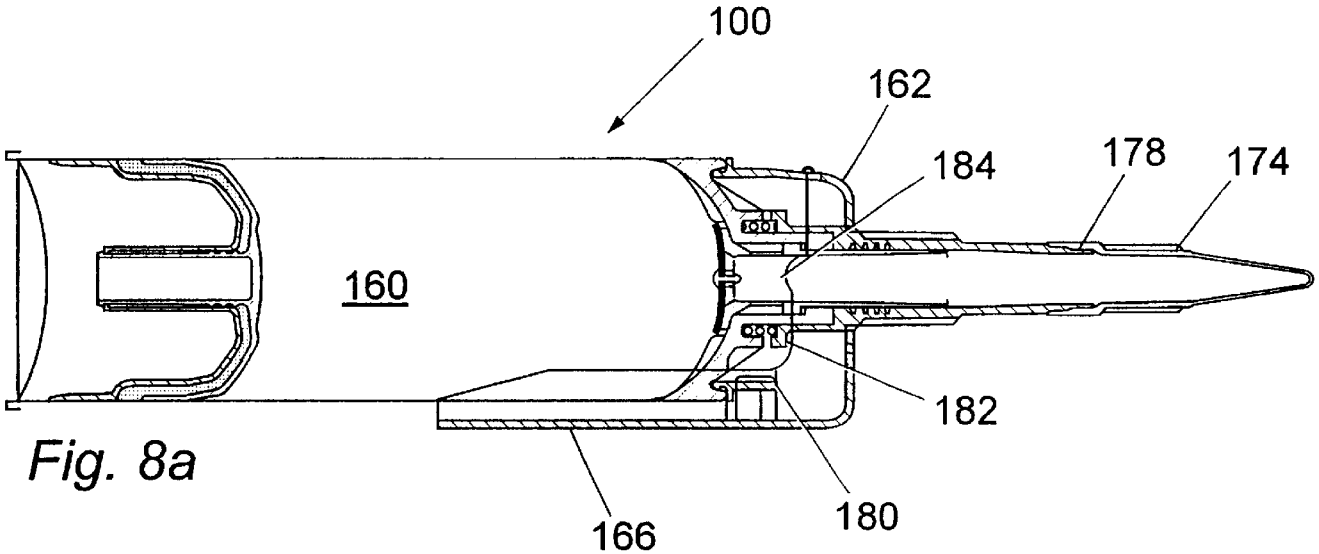
FIGS. 8*a*–8*c* are side views in cross-section of the apparatus of FIG. 1 during use.

The lever cap 162 is shown in place in FIG. 8*a*, for example. The pack 100 is completed with a nozzle 174 and a protective end cap (see 276 in FIG. 3, for example) which is fitted after the lever cap 162. The nozzle 174 is screwed onto an external screw thread 178 provided on the actuator 108. Different lengths of nozzle may be used if required.

Figure 8B:
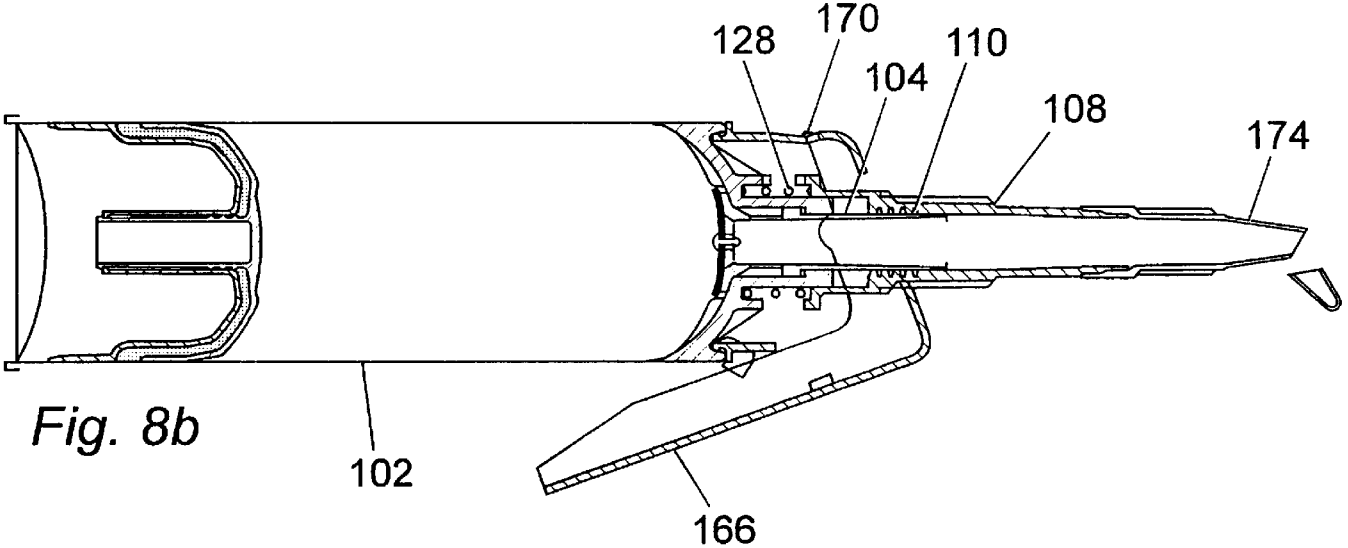
Figure 8C:
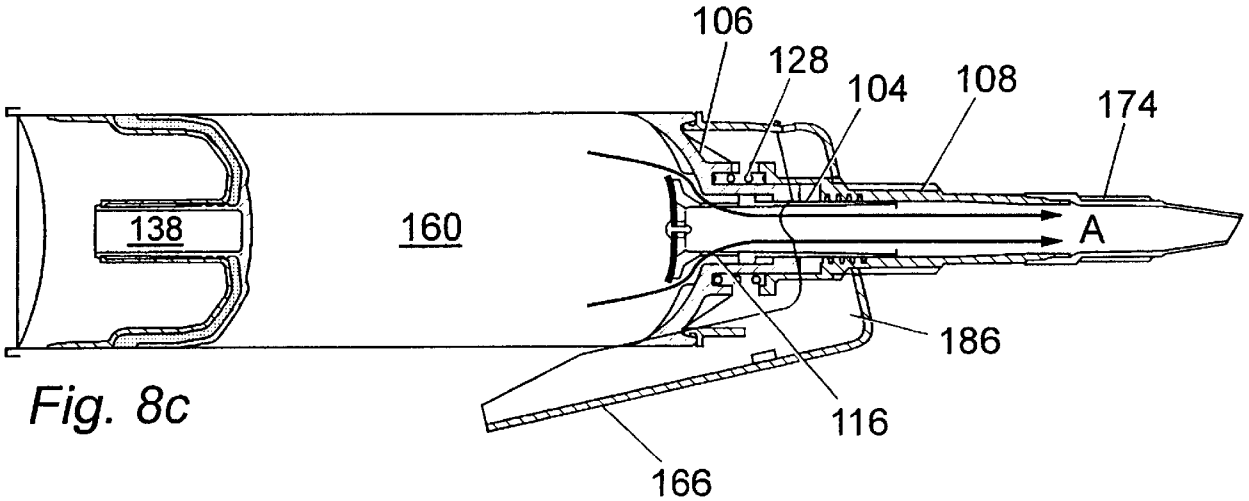

The lever cap 162 may also be provided with a seal mechanism 180 (as can be seen in FIGS. 8*a*–8*c*). The seal 180 prevents unwanted movement of the lever handle 166 prior to first use and serves as an indication of any tampering.

Referring now to FIGS. 8*a*–8*c*, the pack 100 is shown in FIG. 8*a* in the form in which it is retailed. Volume 160 is filled with product and the handle 166 of the lever 162 is in the fully closed position. Seal 180 is still intact. The lever handle 166 rests on a flange 182 provided around the bottom of the actuator 108. An actuating knuckle 184 on the handle 166 contacts the flange 182. The knuckle 184 can be seen in FIG. 5.

To dispense product, the seal 180 is broken, the end cap is removed and the nozzle 174 is cut open. The actuator 108 is then twisted relative to the valve portion 104 on screw thread 110. The screw thread is preferably an acme triple thread. Typically one 360° turn will fully open the pack 100.

The broken seal 180 can be seen in FIG. 8*b*. An alternative seal arrangement could be provided on the pack, as sold, consisting of an anti-tamper tab. This tab could be a piece of plastic adapted to attach to the lever handle and fit within one of the grooves 190 described below. When attached, abutment of the seal against the side of the groove prevents turning of the actuator relative to the lever handle and also prevents lifting of the lever handle. The seal is broken by a user pulling off the piece of plastic prior to use of the pack. This seal may be provided on the dog tooth 188 described below, for example.

As the actuator 108 turns, the lever handle 166 lifts on the hinge 170 due to the action of the actuator flange 182 against the actuating knuckle 184. This can be seen in the view of FIG. 8b. The greater the flow rate of product required, the more the lever handle should be raised prior to use. The spring 128 is extended at this point.

To dispense product, a user then presses down on the lever handle 166 (moving it toward the body of the can 102). This pushes the actuator 108 and the valve 104 (which is attached to the actuator 108 via their cooperating screw threads 110,126) down relative to the boss 106. This is the position seen in FIG. 8*c*. Product is then urged to flow, by virtue of the internal pressurisation of the pack 100 against the piston 138 which then moves up toward the valve 104 forcing product from volume 160 through the ports 116 and up through the valve portion 104 and out through the nozzle 174 (in the direction of arrows A in FIG. 8*c*). Because the area of the ports is greater than the bore diameter, the flow rate is the same as with conventional packs. Backfill is also possible for this reason.

To stop dispensing, the user simply releases the lever handle 166. This closes the valve by allowing it to slide back up the bore and closing access through the ports 116. If a spring 128 is included in the pack, it will urge the valve closed, but in many cases the internal pack pressure will close the valve reliably, without the need for a spring.

The greater the angle between the lever handle 166 and the can 102 prior to dispensing, the greater the possible torque on the actuator/valve and hence the greater the flow rate obtained from the pack 100. Markings may be provided (by moulding for example) on the side face 186 of the lever handle 166 which indicate the flow rate that will be achieved when depressing the handle 166 from that lever angle.

The lever 162 is also provided with a dog tooth 188 on the interior of the aperture 172 in the lever handle 166. This dog tooth 188 is designed to fit into slots or axial grooves 190 (see FIG. 4) provided adjacent the top of the actuator 108. If the actuator 108 is unscrewed and the lever handle 166 rises sufficiently, the dog tooth 188 engages in one of these grooves 190 and butts against the side of the groove 190 to prevent further turning. In this way, the actuator/valve cannot be fully removed from the pack.

In addition, the flange 182 of the actuator 108 is provided with a projection 192 on its lower surface. This projection 192 can be seen in FIG. 2 and is designed to click into one of a set of corresponding indents (not shown) provided at equal intervals around a ring on the top surface of the boss 106 when the actuator 108 reaches the fully closed position. This indicates to a user that the actuator 108 is "locked-off".

Embodiments of the invention are envisaged whereby product can be dispensed in a predetermined dose. Doses may be adjusted by adjusting the nozzle length.

Figure 9:
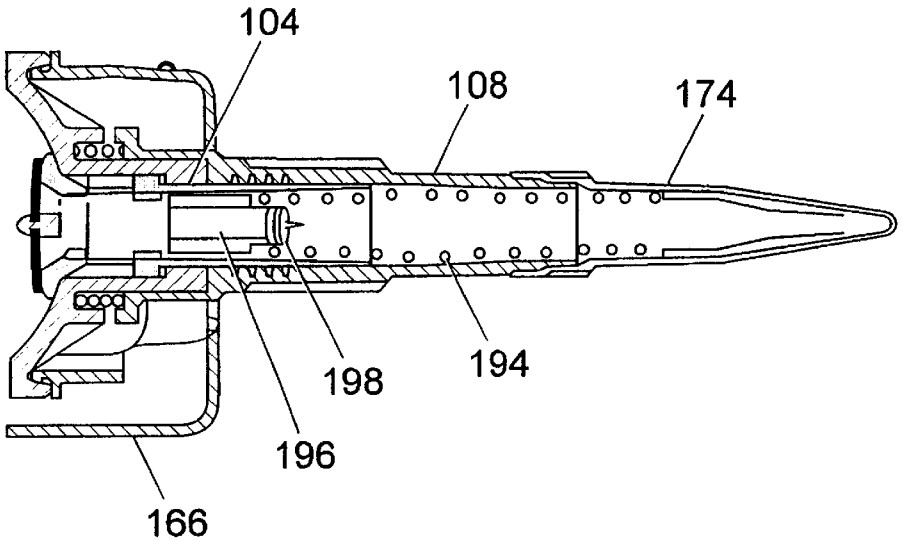
FIG. 9 is a cross-sectional view of the nozzle area of apparatus in accordance with a further embodiment of the present invention, adapted to dispense predetermined doses of a product.

Part of one such embodiment can be seen in FIG. 9 of the accompanying drawings. The apparatus of FIG. 9 is substantially identical to that already described, but is provided with a return spring 194 and a piston/valve assembly 196 within the interior of the nozzle 174, valve 104 and actuator 108. FIG. 9 shows the actuator 108 in the fully closed position.

The piston/valve assembly 196 is in the form of a cylindrical hollow cage which is a sliding fit within the interior of the nozzle, etc. The assembly 196 is provided with a one-way valve 198 at the end nearest the spring 194. In this embodiment, the first time the lever handle 166 is raised and depressed, product is forced up behind the cage, and the pressure then forces the piston/valve assembly 196 toward the nozzle end (the valve 198 remaining closed). This in turn compresses the return spring 194. When the handle 166 is released, the spring 194 forces the assembly 196 back down, the valve 198 being open in this phase, thereby leaving a dose of product (which passes through the cage and the open valve) within the interior of the nozzle, etc. To dispense the dose, the handle 166 is raised and depressed again. This action simultaneously "refills" the interior with a further dose of product for the next application. This procedure can be continued until the apparatus is empty. An end cap (not shown) protects the dose from exposure to the atmosphere when the apparatus is not in use. It is envisaged that apparatus having the features shown in FIG. 9 would be particularly suitable for dispensing of pharmaceuticals and the like.

The components of a preferred piston assembly will now be described with reference to FIGS. 10, 11 and 12.

The piston assembly consists of a primary piston 200 and a secondary piston 202. Both pistons 200, 202 are generally cup shaped, with stem portions 204, 206 in their centres. The pistons 200, 202 are designed to interlock with one another, by means of teeth 208 on the stem of the primary piston 200 and a flange 210 on the stem of the secondary piston 202, thereby defining a sealant chamber. In use, the sealant chamber is filled with sealant. In the piston assembly formed from pistons 200 and 202, approximately 7g of sealant is required to fill the chamber. This compares favourably with over 30g required to fill sealant chambers in known piston assemblies. This reduces costs involved in manufacture of packs incorporating the piston assembly of the present invention.

Figure 10:
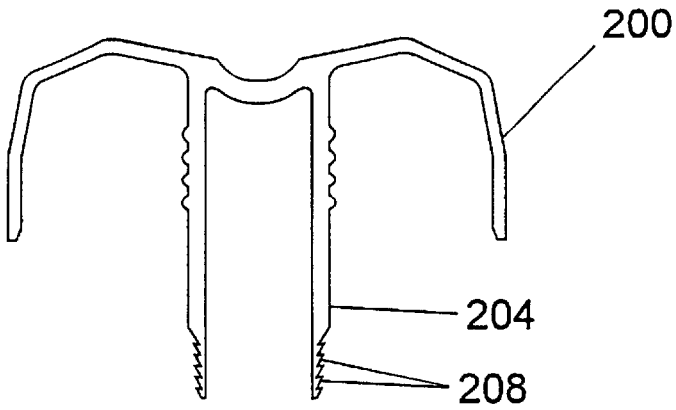
FIG. 10 is a view in cross-section of a primary piston of a piston assembly in accordance with the present invention.
Figure 11:
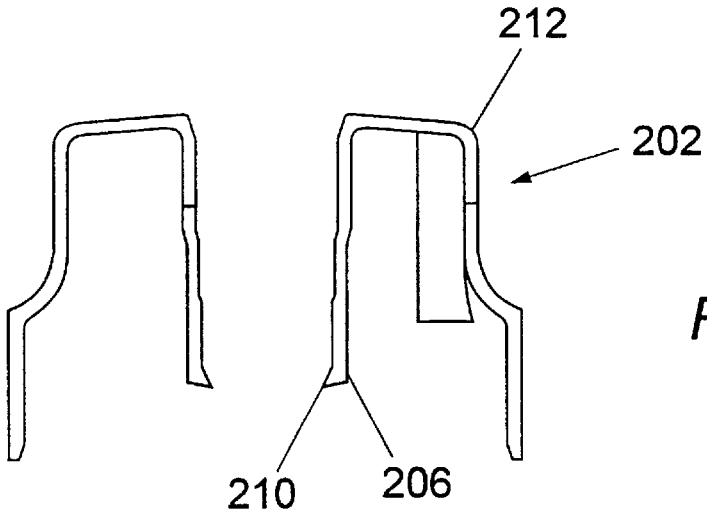
FIG. 11 is a view in cross-section of a secondary piston which cooperates with the primary piston of FIG. 10.
Figure 12:
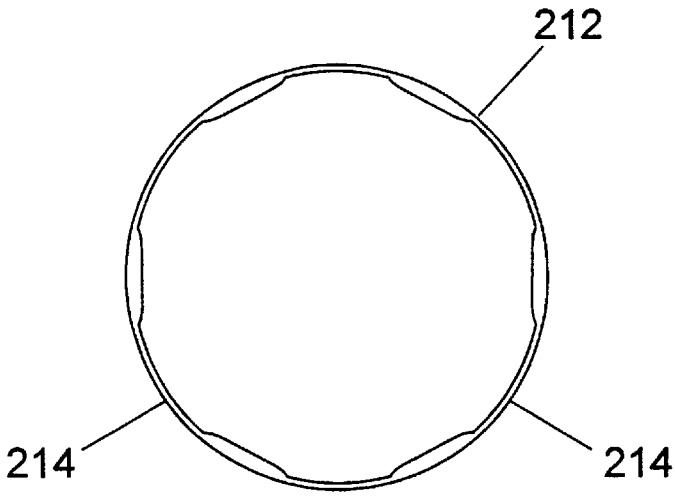
FIG. 12 is a plan view of the top part of the wall of the piston of FIG. 11, showing the relative thickness of each part of the wall.

The example shown in FIGS. 10 to 12 has a further advantageous feature in that the top wall 212 of the secondary piston 202 is made from a flexible plastic material having a number of thin pocket sections 214 therein. These pockets 214 are designed to balloon on expansion of sealant within the sealant chamber (as occurs during storage of a filled pack), thereby accommodating the sealant and preventing the primary and secondary pistons from separating or becoming unlocked from one another. This is a significant advantage of the piston assembly of the present invention.

Figure 13:
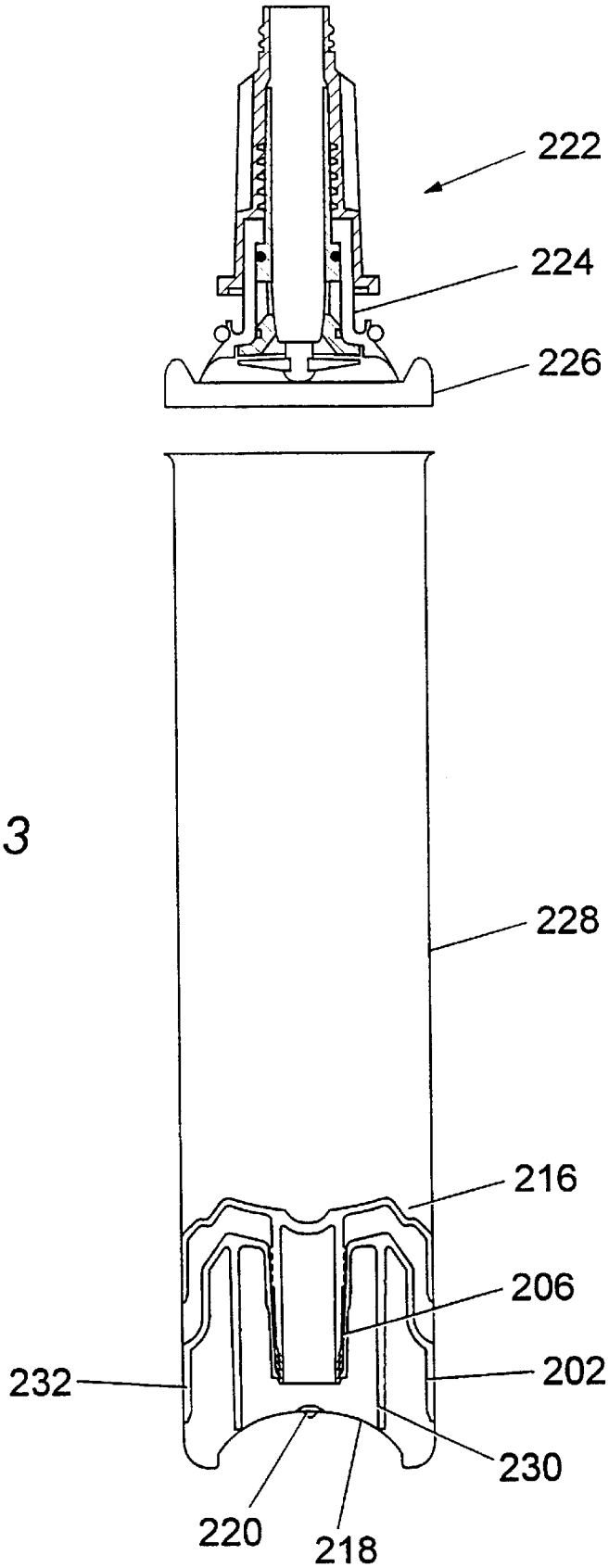
FIG. 13 is a side view in cross-section of apparatus in accordance with yet a further embodiment of the present invention, suitable for "backward" filling.

Referring now to FIG. 13, there is shown a piston assembly 216 similar to that described above with reference to FIGS. 10 to 12, within a standard two piece aerosol can. This arrangement differs from that described earlier in that the can must be "backward filled" with the components as the bottom end 218 is initially sealed apart from a small fill valve 220.

The valve assembly 222 of the pack of FIG. 13 and in particular, the boss portion 224 is specially designed to fit snugly within the top piece 226 of the two piece can. The view of FIG. 13 shows the top piece 226 (with valve assembly 222 therein) just prior to fitting onto the can section 228.

It should be noted that the boss portion 224 is only one of many possible fittings for the top piece 226. The top piece 226 is a standard open top cone and may, in other embodiments, have other valve assemblies fitted therein. For example, a standard aerosol valve such as a spray valve or tilt valve (for dispensing cream, etc) may be fitted. It should also be noted that the upper profile of the piston assembly may require modification to accommodate components of such valves which protrude into the body of the can. This may be achieved using the hollow stem of the secondary (uppermost) piston to make room for the valve components when the piston assembly is in its uppermost position.

In the embodiment of FIG. 13, the secondary piston 202 is introduced into the can first. The hollow stem 206 of the secondary piston 202 allows air to escape from the space between the piston 202 and the bottom 218 of the can when the piston 202 is being inserted. It will be noted that a cylindrical tube 230 is provided on the underside of the secondary piston 202, which contacts the base of the can before the rest of the piston 202, thereby leaving a space between the outer skirt 232 of the piston 202 and the base 218 of the can.

Following the insertion of the secondary piston, the primary piston 200 (with sealant therein) is inserted into the can. As the primary piston 200 is forced down the can, air can escape from underneath the primary piston 200, through the hollow stem 206 of the other piston 202 and out through the valve 220 in the base of the can. This air escape can take place up to the point where the pistons 200, 202 engage one another. Any remaining air trapped between the pistons can then travel down the sides of the secondary piston 202, (the pressure of the air temporarily collapsing the outer skirt 232), and through apertures (not shown) in the bottom of the tube 230 of the secondary piston 202, to eventually escape through the valve 220. The can is then ready to have the top piece 226 fitted. It should be noted that any top piece/valve assembly may be fitted depending on an end user's requirements.

Figure 14:
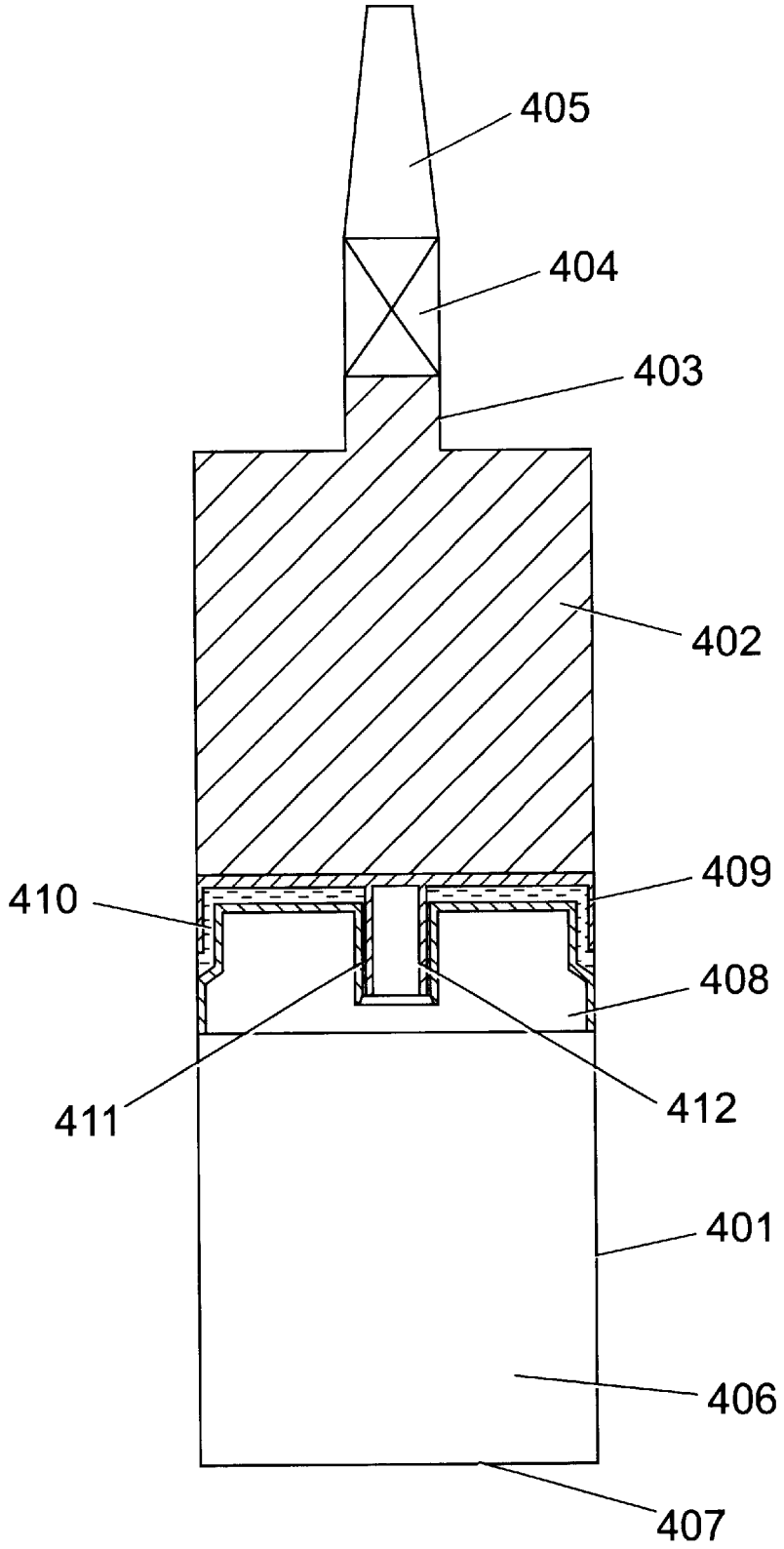
FIG. 14 is a cross-sectional view through a container showing a composite piston in accordance with another embodiment of the invention within the container.

The components of a piston assembly according to a further embodiment of the invention will now be described with reference to FIGS. 14 to 18. FIG. 14 shows a cross-sectional view through a container 401 which contains a product 402 which is to be dispensed through an outlet 403 in the container 401 to a valve 404 which controls dispensing of the product through a nozzle 405. The valve 404 which is attached to the outlet 403 by a screw thread and the nozzle 405 is attached to the valve 404 also by a screw thread.

Located within the container 401 are two pistons 408, 409 between which a viscous material 410 is located. The pistons 408, 409 and the viscous material 410 separate the product 402 from a propellant 406 in the container 401. The propellant may be any suitable propellant. Typically, the propellant is a substance which is gaseous at normal temperature and pressure but liquifies when pressurised.

The pistons 408, 409 are coupled to each other by a central tube section 412 on the piston 409 which engages with a central aperture 411 in the piston 408. The pistons 408, 409 are shown in more detail in FIGS. 15 and 16.

Figure 15:
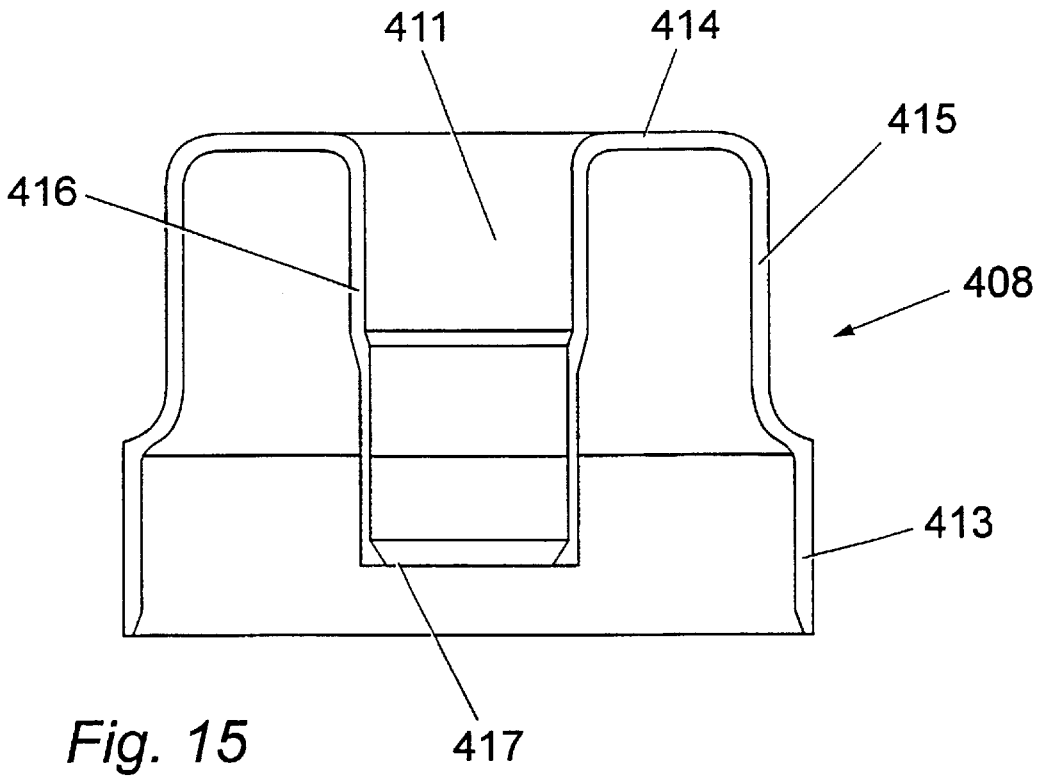
FIG. 15 is a cross-sectional view through a lower piston for use in the composite piston shown in FIG. 14.

FIG. 15 is a cross-sectional view of the piston 408. The piston 408 has a skirt section 413 which contacts the inside surface of the wall of the container 401. The piston 408 also has an annular section 414 which is connected to the skirt section 413 by a side wall 415. A central tubular section 416 depends from the inside of the annular section 414 to define the central aperture 411. Located at the end of the tubular section 416, remote from the annular section 414, is a nibbed flange 417 which is directed towards the centre of the aperture 411. The portion of the tubular section 416 on which the flange 417 is located has a wall thickness less than the portion of the tubular section 416 adjacent the annular section 414 to enable the flange 417 to flex outwards.

Figure 16:
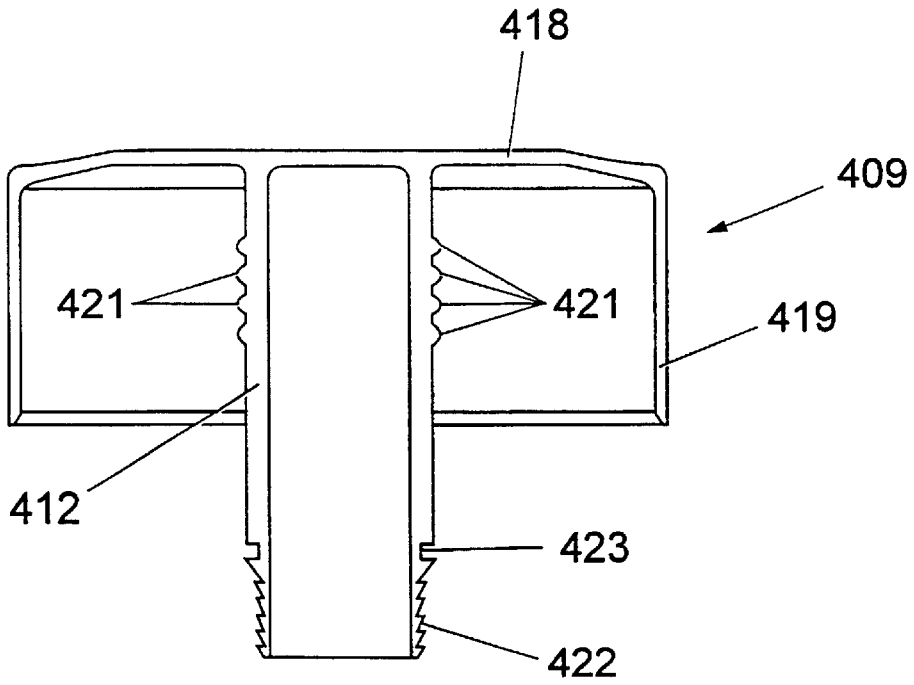
FIG. 16 is a cross-sectional view through an upper piston for use in the composite piston shown in FIG. 14.
Figure 17:
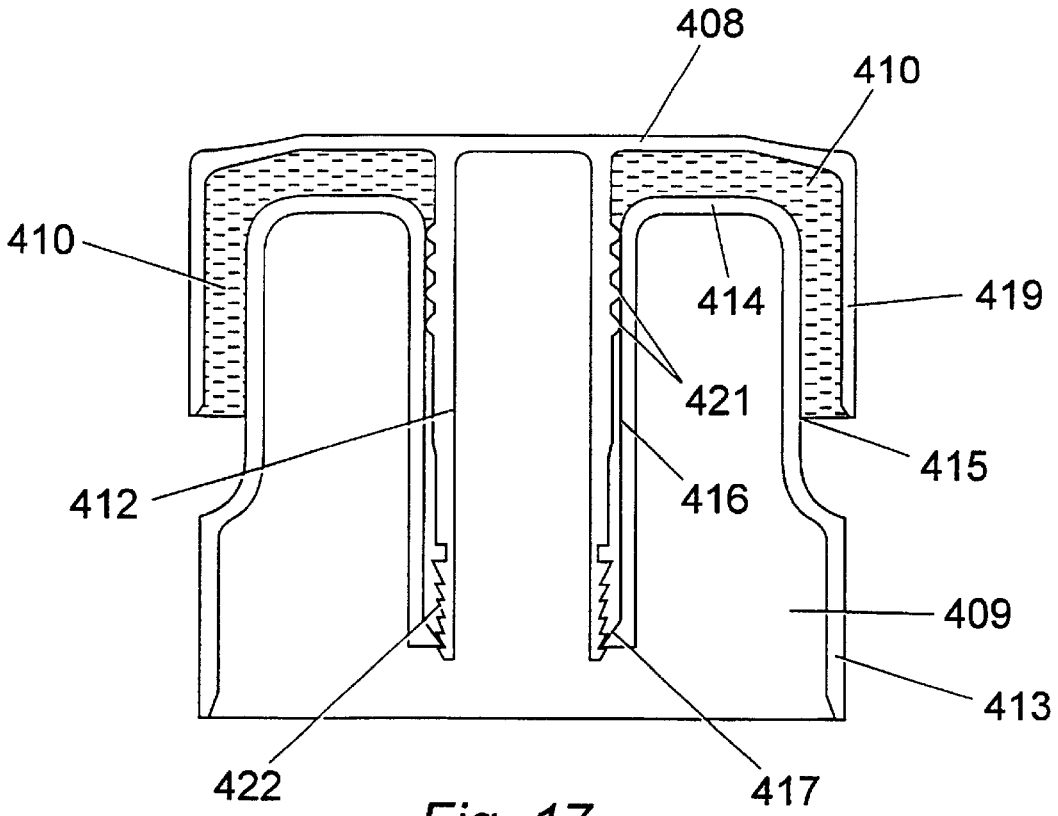
FIG. 17 is a cross-sectional view of the upper and lower pistons of FIGS. 15 and 16 coupled together in a spaced apart position.

FIG. 16 is a cross-sectional view of the piston 409. The piston 409 has a central section 418 from which depends a skirt section 419 which engages with the inside wall of the container 401. Depending centrally from the central section 418 is the tube section 412 which has a number of ridges 421 adjacent the central section 418 and a ratchet portion 422 at the end of the tube section 412 remote from the central section 418.

Next to the ratchet formations 422 is a groove 423 which extends circumferentially around the tube section 412.

In use, the section of piston 409 between the tube section 412 and the skirt 419 is filled with the viscous material 410. The tube section 412 is then inserted into the central aperture 411 in the piston 408 defined by the tubular section 416 until the ratchet formations 422 contact the flange 417. Further pushing together of the pistons 408, 409 causes deflection of the flange 417 to engage in the ratchet formations 422. The ratchet formations are shaped such that pistons 408, 409 may be pushed together but they may not be easily separated after the flange 417 has engaged in the ratchet formations 422.

Ridges 421 frictionally engage with the internal side walls of the tubular section 416 and help prevent the viscous material passing between the tubular section 416 of the piston 408 and the tube section 412 of the piston 409.

The composite piston formed by the pistons 408, 409 and the viscous material 410 may then be inserted into the container 401 and used as shown in FIG. 14.

The invention has the advantage that the interengaged flange 417 and ratchet formations 422 mitigate the possibility of the pistons 408, 409 separating due to propellant 406 entering the viscous material 410 between the pistons 408, 409 and pushing the pistons 408, 409 apart which may compromise the effectiveness of the composite piston in mitigating the possibility of the propellant 406 leaking into the product 402.

Figure 18:
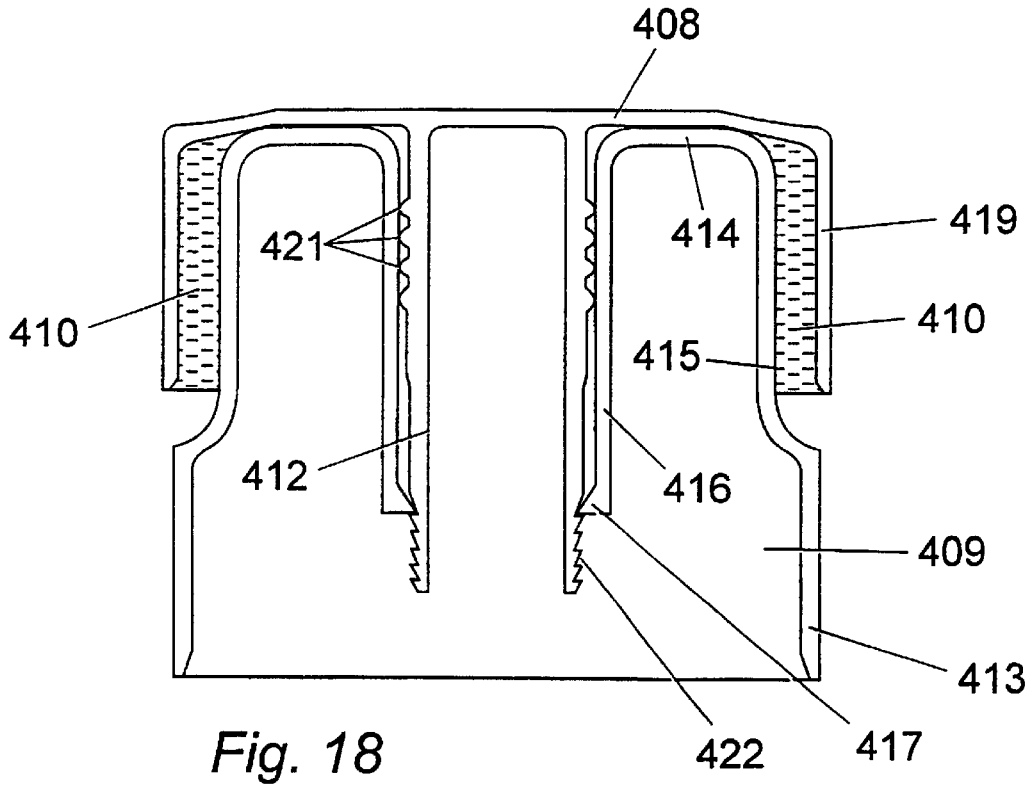
FIG. 18 is a cross-sectional view of the upper and lower pistons of FIGS. 15 and 16 coupled together in a closed position.

However, the pistons 408, 409 are permitted to move towards each other to ensure that there is a constant force of viscous material pressed against the inside wall of the container, as the flange 417 can move further up the ratchet formations 422 until the annular section 414 butts against the central section 418, as shown in FIG. 18.

The presence of the viscous material 410 on the inside wall of the container reduces the frictional forces between the wall engaging skirts 413, 419 and helps to give a smooth movement of the pistons 408, 409 within the container 401. In addition or alternatively, the viscous material 410 may also be used as a sealing material to help prevent components of the product permeating either through the pistons 408, 409 or between the wall engaging skirts 413, 419 and the inside wall of the container 401.

In the example shown in FIG. 14, the pistons are pushed towards the outlet 403 by the propellant 406 when the valve 404 is opened by a user. This causes the product 402 to exit the outlet 403, pass through the valve 404 and pass out through the nozzle 405.

However, in an alternative example the propellant 406 and the base 407 of the container 401 may be omitted. In this example, the container 401 may be inserted into a mechanical device (not shown) which pushes the pistons 408, 409 towards the outlet 403 in order to dispense product 402 from the outlet 403 and desired by a user.

Figure 19A:
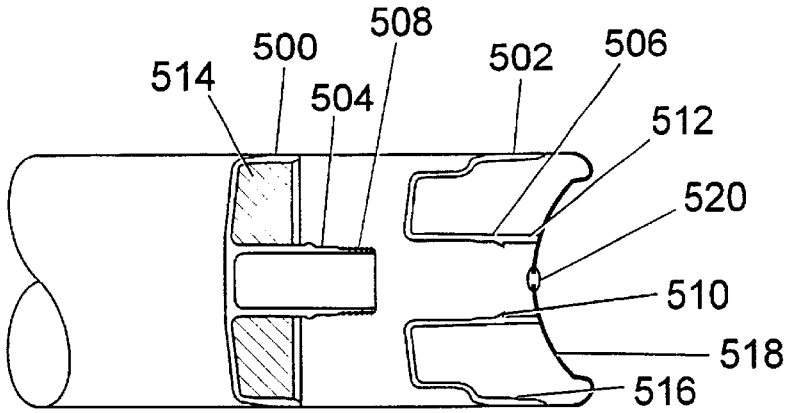
FIGS. 19*a*–19*d* are side views in cross-section of the apparatus in accordance with another embodiment of the invention during use.
Figure 19B:
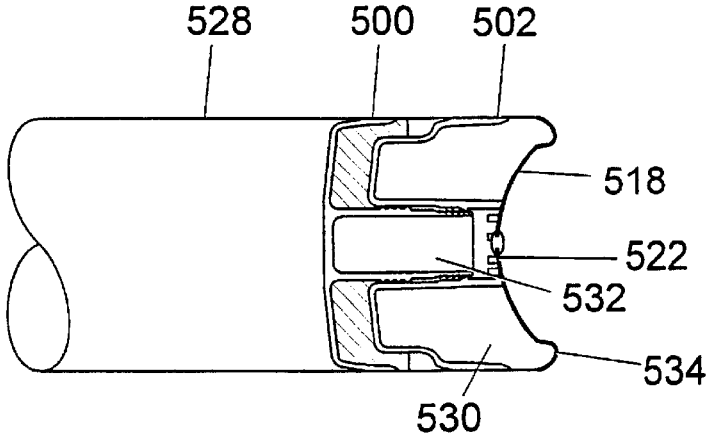
Figure 19C:
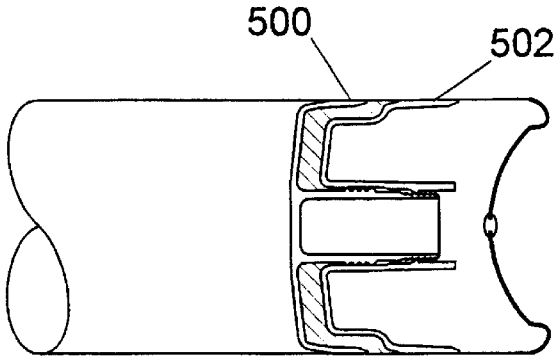

Referring now to FIGS. 19*a* to 19*d*, a modified composite piston is shown in which a detent portion 510 is provided not at the end of the stem or tube section 506 of the secondary piston 502, but at an intermediate point on the stem 506. During assembly of the composite piston, the secondary piston 502 is pushed into the container 528 until the end 512 of the stem 506 abuts the domed base 518 of the container, as shown in FIG. 19*a*. Castellations 522 may be provided in the stem wall arranged around the circumference of the end 512 of the stem, to enable air to pass from the volume 530 outside the stem to the volume 532 inside the stem and vice versa. As shown in FIG. 19*b* the primary piston 500 is then pushed into the container until the first indented portion of the ratchet formation 508 engages with the detent 510 in the first click position. As the primary piston 500 is pushed further so that the third indented portion of the ratchet formation 508 engages with the detent 510 in the third click position, the sealant 514 fills the space between the primary and secondary pistons, and escaping air is pushed between the wall engaging skirt 516 and the container to voided volume 530, from where it can escape through the valve 520. FIG. 19*c* shows the primary and second pistons in the third click position.

Figure 19D:
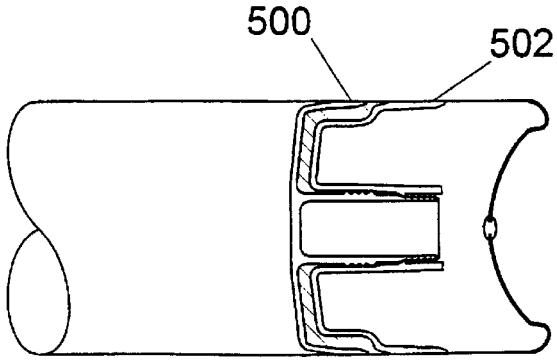

The sealant 514 is placed in the primary piston in a predetermined dose. There is a tolerance on the volume of this dose. The ratchet formation 508 enables the composite piston to function equally well if the volume of sealant is slightly more or less than the standard volume. If there is more sealant, then sealant will fill the space when the second indented portion of the ratchet formation 508 engages with the detent 510 in the second click position. If there is less sealant, then sealant will fill the space when the fifth indented portion of the ratchet formation 508 engages with the detent 510 in the fifth click position, as shown in FIG. 19*d*, when the end of the primary stem 504 is flush with the end of the secondary stem 506.

The stem 506 extends a sufficient distance so that it engages with the domed base 518 of the container before the wall engaging skirt 516 engages the curved portion 534 of the container, where the container wall 528 ceases to be straight. In this way air can still escape between the skirt 516 and the container wall 528.

Figure 20:
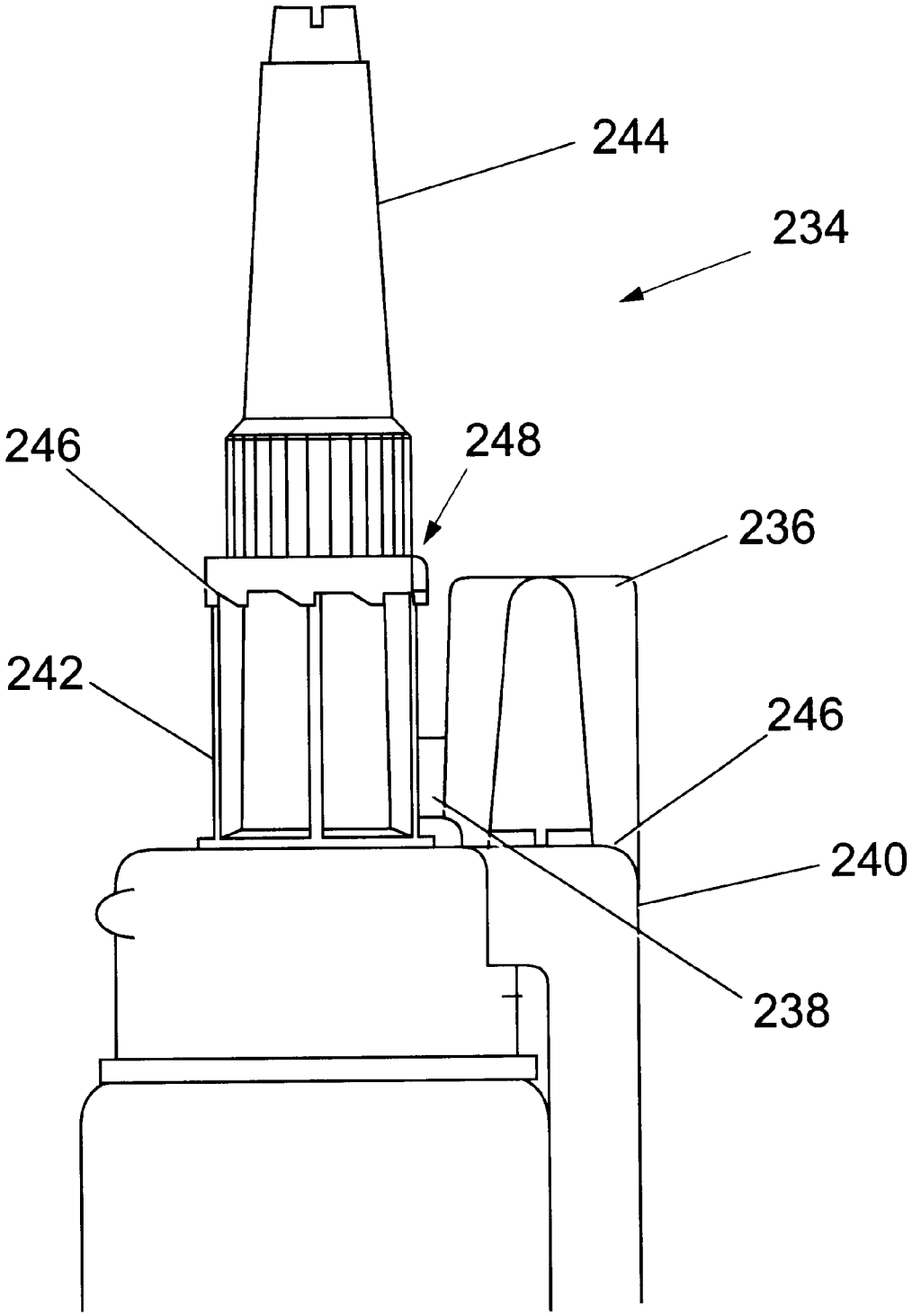
FIG. 20 is a side view of the top part of apparatus in accordance with the present invention, showing an improved tamper seal arrangement.

Referring now to FIG. 20, an improved nozzle/end cap arrangement 234 can be seen. This arrangement combines the end cap 236 with the anti-tamper tab 238 of the assembly. The end cap 236 in this example is formed integrally with the lever cap 240 during moulding. The anti-tamper tab 238 comprises a Y-shaped piece of plastic which engages one of the eight flutes 242 provided on the valve actuator as can be seen in FIG. 20. The tab 238 is broken off prior to first turning of the actuator, to allow for normal use of the pack.

The view seen in FIG. 20, with the end cap 236 still attached to the lever cap 240, is as the pack would be presented for sale. This advantageously reduces the overall height of the pack, by removing the end cap from the nozzle 244, so that it may fit more readily onto product display shelving. Optionally, nozzle length may also be reduced, if required.

After purchase, when the nozzle 244 has been cut open, the nozzle can be protected by breaking off the end cap 236 from the lever cap 240 (at snap off bridges 246 provided therebetween) and placing the end cap 236 onto the end of the nozzle 244. This breaking off of the end cap 236 also removes the Y-shaped tab 238 from engagement with the actuator flutes 242.

The nozzle 244 also is provided with teeth 246 at its lowermost end. These teeth 246 cooperate with the flutes 242 on the actuator to prevent unwanted removal of the nozzle. Radial bridges 248 are provided which are adapted to break off when the nozzle 244 is unscrewed with sufficient force. This web/ratchet arrangement acts as a convenient deterrent to unwanted removal of the nozzle prior to purchase, and as an indicator of any tampering.

In general, the apparatus already described includes a boss portion which is inserted up the middle of the empty canister with the valve assembly therein. However, it is possible to mount the valve assembly on the top end of a canister by means of a specially adapted mounting cap. An example of the mounting cap 600 can be seen in FIG. 21.

The valve 601 is mounted in the cap 600 and an actuator 602 fitted to the valve 601 in a similar manner to that previously described. An optional support component 603 may be provided as can be seen on the right hand side of FIG. 21. Alternatively, the support component is not provided, and the cap 600 continues upwards to form a sleeve 604 surrounding the entry valve 601 to the underside of the actuator 602, as can be seen on the left hand side of FIG. 21. A spring 605 is also provided (the benefits of which have already been discussed with reference to other drawings) which at one end sits within a recess 606 provided in the actuator.

The entire valve/actuator/mounting cap assembly is then lowered onto the top of a canister 607 (in this case a two piece aerosol can) and crimped over the top, by crimping a curled lip 608 provided on the cap 600 around the outside of the top rim 609 of the can. The top rim 609 is typically a circular rim 1 inch (25.4 mm) in diameter, of the sort generally known in the art.

The can 600 could alternatively be a three-piece aerosol can (with sealing dome) or any known aerosol with a hole provided in the top. Alternatively the can 600 may be a one piece can formed with tapering sides which narrow towards the circular rim, which is typically 1 inch or 25.4 mm in diameter.

The valve assembly in this example is modified from those of earlier described embodiments. A nozzle 610 with end cap 611 is fitted to the valve 601 by means of a screw thread 620 of increased length, for greater strength. The nozzle 610 is not directly connected to the actuator 602. This assembly has advantages over those already described, for example as the nozzle is tightened onto the valve, this does not cause the valve to open and so no product weeps out of the end of the nozzle.

Figure 21:
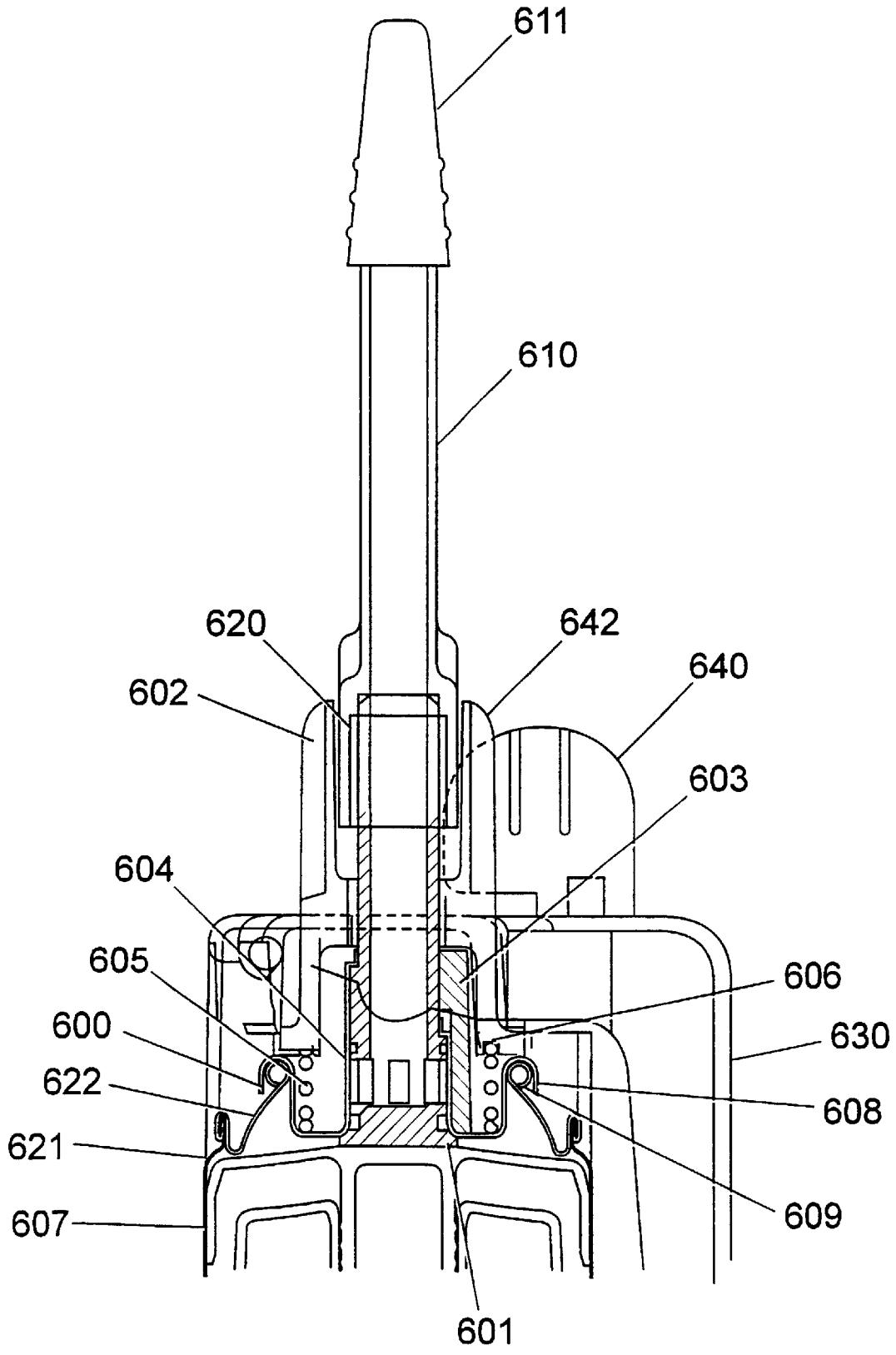
FIG. 21 is a view in cross-section of the nozzle end of apparatus in accordance with yet another embodiment of the present invention.

Other components shown in FIG. 21 are similar to those already described. It should be noted that the plastic lever 630 already described could be replaced by a more simple lever arrangement, for example a conventional wire lever could be used. The container is filled in the following manner. First the composite piston is inserted into the can while the top of the can is open and lip 621 is flared outwardly to aid insertion of the piston. Then the can is closed to form a one inch (25.4 mm) hole, either by fitting top piece 622 or by forming the can to a taper. The can is then filled with the product from the top. Then the valve assembly comprising the valve 601, actuator 602, nozzle 610, cap 600 and lever is fixed to the top rim 609 by crimping the curled lip 608.

The anti-tamper tab 640 comprises a planar piece of plastic connected to the lever 630 which engages one of the eight flutes 642 provided on the valve actuator. The tab 640 is broken off prior to screwing on the nozzle 610 and the first turning of the actuator, to allow for normal use of the pack.

Another advantage of the embodiment of FIG. 21 is that no boss is required to fit the valve assembly. This means that the ultimate capacity of the can can be greater than with the other described embodiments, and the overall appearance of the pack is not substantially affected.

Figure 22A:
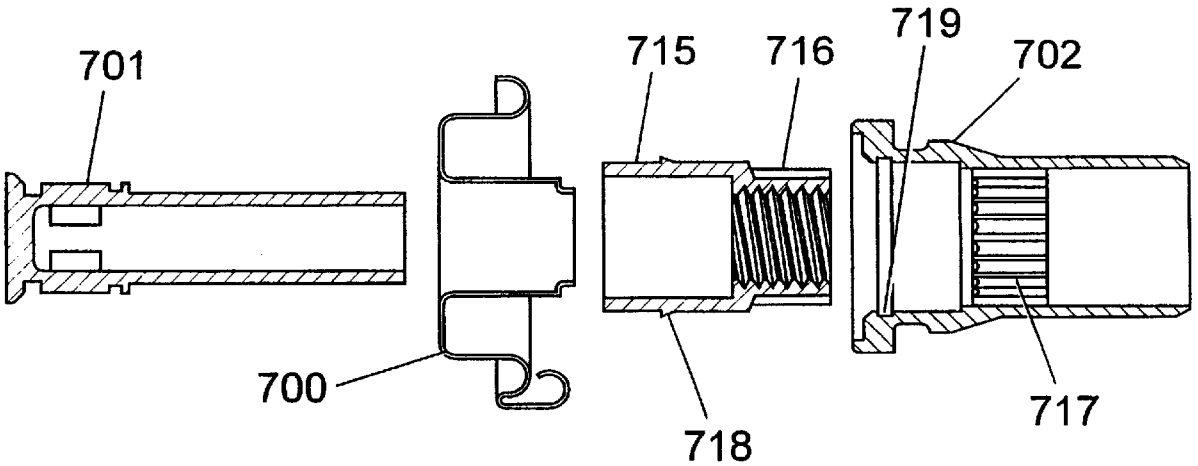
FIGS. 22*a* and 22*b* are exploded views in cross-section of the nozzle end of apparatus in accordance with a further embodiment of the present invention.
Figure 22B:
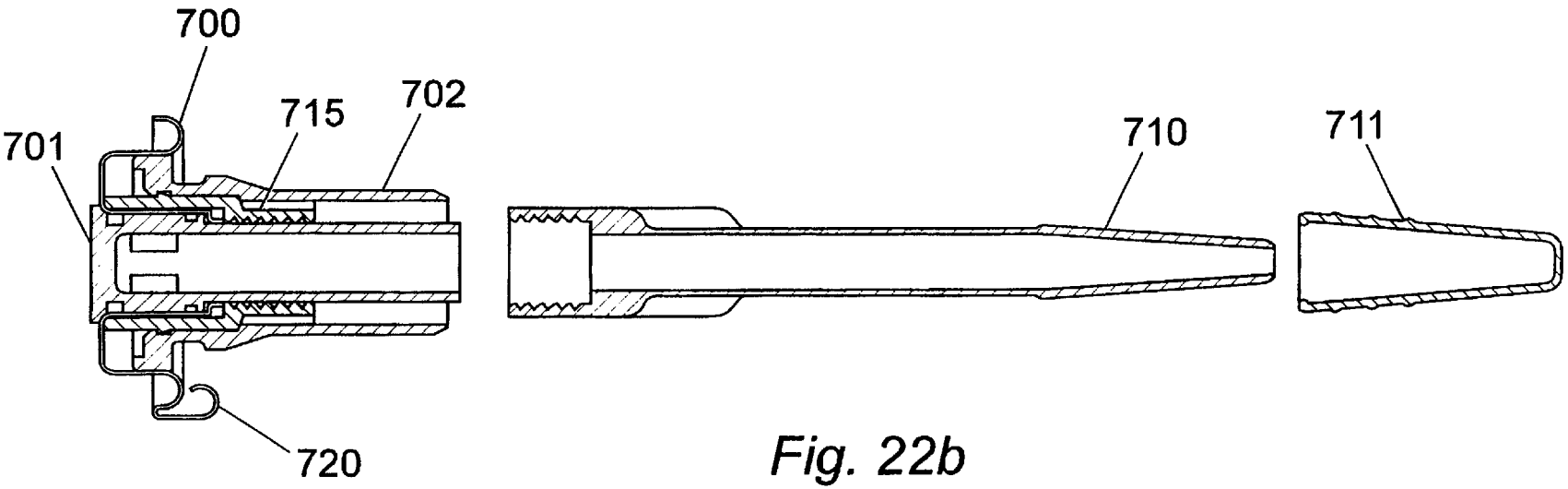

FIGS. 22*a* and 22*b* show exploded views of an embodiment similar to that of FIG. 21. Before fixing the valve assembly to the canister, the valve assembly is assembled by inserting the valve 701 into the cap 700 from below, and then screwing a retaining member 715 provided with an internal thread onto the external thread on the protruding portion of the valve 701 in order to hold the valve in place. The external surface of the retaining member 715 is provided with longitudinal ribs 716. The actuator 702 is provided with corresponding internal ribs 717. When the actuator 702 is placed over the retaining member 715 the ribs 716, 717 engage with each other so that the actuator 702 and the retaining member 715 are rotationally coupled. A detent portion 718 on the external surface of the retaining member 715 engages with a corresponding recessed groove 719 on the inner surface of the actuator 702, to hold the actuator 702 on the retaining member 715. The nozzle 710 and end cap 711 are screwed to the valve 701, in a similar way to the embodiment of FIG. 21. The cap may be provided with a hinge portion 720 for use with a conventional wire lever to control the valve operation. Alternatively the cap may be used with a moulded plastic lever of the type shown in FIGS. 8*a* and 8*b*.

It is to be understood that the containers according to the invention may be filled from the bottom, if required, by providing a separate domed base which is sealed to the container after insertion of the product and the composite piston.

The packs described have significant advantages over and above known packs including that they may be filled and refilled by manufacturers or retailers on their own premises from bulk quantities of product, instead of sending product to be filled into the packs during manufacture. This means that product-filled packs are much cheaper and easier to produce. The packs themselves are also much cheaper and easier to produce.

Modifications and improvements may be made to the foregoing without departing from the scope of the invention.

What is claimed is:

1. Composite piston for use in dispensing apparatus, said composite piston comprising a first piston, a second piston, a wall engaging skirt and a coupling means, the coupling means movably coupling the first and second pistons to each other and permitting limited relative movement between the first and second pistons in a direction substantially parallel to the direction of movement of the composite piston, wherein the coupling means comprises a central stem on one of the first and second pistons and a central aperture in the other of the first and second pistons, the stem being spaced radially from the wall engaging skirt and arranged to engage in the aperture to couple the first and second pistons to each other.

2. Composite piston according to claim 1, wherein the projection and the recess include mutually engageable ratchet formations which permit movement of the pistons relative to each other in one direction only.

3. Composite piston according to claim 1, wherein the pistons are manufactured from a flexible, resilient material.

4. Dispensing apparatus comprising a composite piston according to claim 1.

5. Composite piston according to claim 1, wherein the first and second pistons interlock in use defining a piston sealant chamber.

6. Composite piston according to claim 5, wherein the piston sealant chamber is open circumferentially.

7. Composite piston according to claim 1, wherein the composite piston also includes a viscous substance which in use contacts the inside wall of a container adjacent the composite piston and is adapted to facilitate sealing of the composite piston against the inside walls of the container and/or reduce friction between the composite piston and the inside walls of the container.

8. Composite piston according to claim 7, wherein the piston assembly is provided with expansion means for accommodating expansion of the viscous substance, in use.

9. Composite piston according to claim 8, wherein said expansion means comprises thinned portions provided on the first and/or second piston, said thinned portions forming pockets which are adapted to expand in a balloon-like manner to accommodate sealant expansion in use.

10. Container for dispensing a product therefrom, the container comprising a composite piston according to claim 1 movably mounted within the container and an outlet through which the product is dispensed, the container walls and the composite piston defining a product chamber within the container, and movement of the composite piston within the container towards the outlet expelling product through the outlet.

11. Container according to claim 10, wherein the container is a pressure pack dispenser which comprises a propellant system which pushes the piston towards the outlet.

12. Container according to claim 10, wherein the composite piston comprises viscous material located between the first and second pistons and adapted to be forced into engagement with the inside wall of the container by a compression force which acts between the first and second pistons to cause the second piston to move towards the first piston.

13. Container according to claim 12, wherein the wall engaging skirt abuts against an inside wall of the container.

14. Container according to claim 13, wherein a wall-engaging skirt is provided on both the first and the second pistons.

* * * * *